US008187019B2

(12) United States Patent
Reed et al.

(10) Patent No.: US 8,187,019 B2
(45) Date of Patent: May 29, 2012

(54) CONNECTOR WITH INTEGRATED LATCH ASSEMBLY

(75) Inventors: Bruce Reed, Maumelle, AR (US); Harold Keith Lang, Cary, IL (US); Jay Neer, Boca Raton, FL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/062,248

(22) PCT Filed: Sep. 9, 2009

(86) PCT No.: PCT/US2009/056295

§ 371 (c)(1), (2), (4) Date: May 19, 2011

(87) PCT Pub. No.: WO2010/030616

PCT Pub. Date: Mar. 18, 2010

(65) Prior Publication Data

US 2011/0212643 A1 Sep. 1, 2011

Related U.S. Application Data

(60) Provisional application No. 61/171,037, filed on Apr. 20, 2009, provisional application No. 61/171,066, filed on Apr. 20, 2009, provisional application No. 61/170,956, filed on Apr. 20, 2009, provisional application No. 61/153,579, filed on Feb. 18, 2009, provisional application No. 61/117,470, filed on Nov. 24, 2008, provisional application No. 61/110,748, filed on Nov. 3, 2008, provisional application No. 61/095,450, filed on Sep. 9, 2008.

(51) Int. Cl.
*H01R 4/50* (2006.01)

(52) U.S. Cl. ..... 439/345

(58) Field of Classification Search ..... 439/345, 439/352–353, 357–358, 159
See application file for complete search history.

(56) References Cited

U.S. PATENT DOCUMENTS

| | | | | |
|---|---|---|---|---|
| 6,454,577 | B1 | 9/2002 | Yi | |
| 6,629,858 | B2 | 10/2003 | Lo et al. | |
| 6,821,139 | B1 | 11/2004 | Wu | |
| 7,207,823 | B1 * | 4/2007 | Yang | 439/352 |
| 7,354,292 | B1 | 4/2008 | Lloyd et al. | |
| 7,507,103 | B1 * | 3/2009 | Phillips et al. | 439/352 |
| 7,578,692 | B2 * | 8/2009 | Kaneda | 439/352 |
| 7,950,947 | B2 * | 5/2011 | Amidon | 439/353 |
| 7,950,948 | B2 * | 5/2011 | Amidon | 439/353 |
| 2005/0026500 | A1 | 2/2005 | Ji et al. | |

* cited by examiner

*Primary Examiner* — Jean F Duverne
(74) *Attorney, Agent, or Firm* — Stephen L. Sheldon

(57) ABSTRACT

A connector utilizes a latching assembly that has a structure that connects horizontal movement of an actuator to vertical movement of a latching arm. A latching member is provided that grips the exterior of the connector and has a cantilevered latching arm that extends from the member over a mating portion for connection. In its simplest form the latching member includes a continuous retaining collar that fits over the exterior of the connector and exerts a clamping force on the connector so as to retain the latching member in place.

25 Claims, 21 Drawing Sheets

CONNECTOR WITH INTEGRATED LATCH ASSEMBLY

REFERENCES TO RELATED APPLICATIONS

This application is a national phase of international application PCT/US09/56295, filed Sep. 9, 2009 and claims priority to U.S. Provisional Appln. Nos. 61/095,450, filed Sep. 9, 2008; 61/110,748, filed Nov. 3, 2008; 61/117,470, filed Nov. 24, 2008; 61/153,579, filed Feb. 18, 2009, 61/170,956 filed Apr. 20, 2009, 61/171,037, filed Apr. 20, 2009 and 61/171,066, filed Apr. 20, 2009, all of which are incorporated herein by reference in their entirety. This application was filed concurrently with the following applications, which are not admitted as prior art to this application and which are incorporated herein by reference in their entirety:

application Ser. No. 13/062,240, entitled HORIZONTALLY CONFIGURED CONNECTOR; and application Ser. No. 13/062,360, entitled HORIZONTALLY CONFIGURED CONNECTOR WITH EDGE CARD MOUNTING STRUCTURE.

BACKGROUND OF THE INVENTION

The present invention generally relates to connectors suitable for transmitting data, more specifically to input/output (I/O) connectors suitable for dense connector configurations and having a latching mechanism associated therewith.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug convertors. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

SUMMARY OF THE INVENTION

In one embodiment, a connector is provided that has a housing which houses multiple circuit cards to which wires of cables are terminated along the trailing edges thereof. The leading edges of these circuit cards have a plurality of conductive contact pads arranged thereon and they provide points of contact with a plurality of terminals.

The circuit cards in these connectors are arranged in one or more vertical stacks so as not to increase the overall width of the connector, yet still increase the density of available circuits for the connector. The connectors may be configured for assembly in the horizontal direction, meaning that in a single connector, left and right housing side members are provided. For multiple connector housings, such as tandem arrangements, left, right and center housing members are provided which may be joined together horizontally along vertical mating faces coincident with the centerline of an associated connector, or may be offset therefrom. Two means for fastening the housing members together are provided with one fastening means proximate the front mating portion of the connector and the other proximate the rear body portion of the connector.

The front fastening means may preferably take the form of a swageable member that extends horizontally between the walls of the various housing members and generally transverse to a longitudinal axis of the connector and having a head that extends through a hole in one of the connector housing halves where it can be swaged to hold the connector housing halves together. The rear fastening means preferably takes the form of a collar that encompasses at least more than half of the circumference of the rear portion of the connector to apply a clamping face to the connector housing and hold the connector housing halves together. This construction reduces the number of fastening members needed to assemble the connector and reliably hold it together, and their structure does not increase the overall size of the connector.

In another embodiment, the connector structure is such that it may be utilized as a ganged or tandem connector without unduly increasing the width of the connector mating portion (s). This is accomplished by utilizing a center piece that is disposed between and mated to the left and right connector housing halves. The center piece includes, at the mating end of the connector, at least one slot that extends rearwardly from a front edge of the center piece in order to divide the front end of the connector into two separate mating portions. Multiple center pieces can be assembled together with the right and left connector halves to expand the number of distinct mating portions of the connector and such expanded connectors can be made virtually any width with the left, center and right pieces taken from a standard inventory of connector parts.

In instances where the connectors of the invention utilize multiple mating portions, the circuit cards in each mating portion are arranged in a common vertical spacing. Fasteners can be applied to hold the connector housing together and can occupy the intervening space between circuit cards. Adjacent mating portions are identical to each other in that the vertical space(s) separating the circuit cards can be commonly used to accommodate a fastening means.

In yet another embodiment, the connector includes a latching mechanism that includes a latching member including an elongated latching arm that extends lengthwise along the connector body portion and which terminates in an engagement end that extends over the connector mating portion. The latching mechanism includes a retainer that retains the latching member in place on the connector housing and which applies a clamping face to the connector housing.

In one embodiment, the retainer includes the collar described above in order to reduce the number of parts required for assembly. The collar may be continuous so that it extends around the entire periphery of the connector housing, while in another embodiment, the retainer engages a majority of a periphery of the connector housing, but not it all of it. In such embodiments, the retainers are preferably U-shaped or C-shaped. The retainers include engagement members in the form of lugs, or tabs, that extend away from the retainers and into contact with the connector housing, and which extend into and received in recesses formed on the outer surfaces of the connector housing. These engagement members serve to retain the latching member securely in place on the connector in an almost permanent fashion.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

Figure 1:
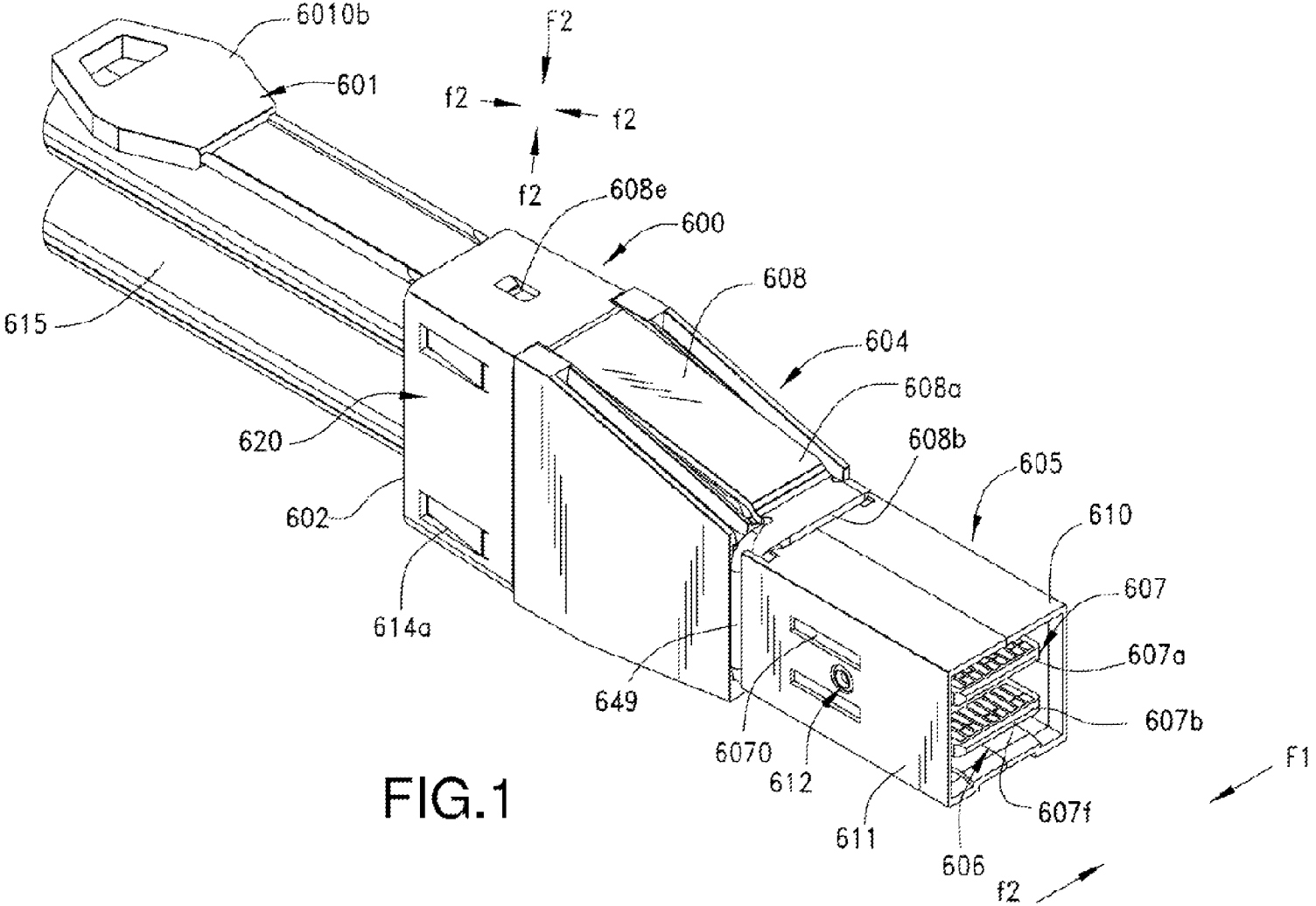
FIG. 1 is a perspective view of an embodiment of a multiple edge card connector.

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

The following disclosure illustrates a latching connector having a higher density without unduly increasing the width of the connector. The depicted features are suitable for what are typically referred to as plug connectors but whether a connector is a plug or receptacle is not critical. In certain embodiments, a connector may be assembled from a plurality of pieces in a horizontal fashion and containing multiple edge cards, oriented horizontally for mating with an opposing connector and a latching mechanism that is fixed to the connector in a reliable manner.

Regarding the depicted connector, as can be appreciated, a wide range of possible configurations may be used and various embodiments of possible connectors are illustrated in the Figures. As can be appreciated, the connector configurations include a fastener positioned between two parallel circuit cards. The fastener holds the connectors housing together and depending on its location, the fastener can also be used to stop to prevent over insertion of the connector into a mating receptacle (thus helping prevent excessive forces from being applied to the terminals and/or the circuit cards).

As can be appreciated, this allows the circuit cards position to be controlled with a high degree of precision while minimizing component costs. And as the portion of the connector with the circuit cards will be positioned inside the mating receptacle, shielding issues are not created.

As can be further appreciated, a three-piece housing may be used to provide for a ganged assembly such as would be suitable for mating with two ports of an opposing, ganged connector, such as a 1×4 ganged connector, and the housing includes a latching mechanism integrated with it for engaging and retaining the connector in mating engagement with an opposing mating connector frame or receptacle.

FIGS. 1-7 illustrate an embodiment of a connector 600. The connector 600 is seen to have a hollow connector housing 601 with an enlarged body portion 604 and an elongated mating portion 605, having a hollow interior recess 606 that supports a pair of mating blades in the form of circuit cards 607 therein to which individual wires 616 held in cables 615 are terminated. The circuit cards 607 mate with and engage conductive terminals of an opposing mating connector (not shown) in order to connect the terminals to the wires 616 of the cables 615. In this regard, the circuit cards 607 take the form of what are known in the art as "paddle cards" and which are arranged in vertically-spaced apart order, and preferably parallel to each other. In this manner, the number of circuits in the connector 600 to connected to an opposing mating connector, (not shown) is increased (in the configuration illustrated, the number is doubled) without increasing the widthwise dimensions of the connector 600. The vertical orientation of the connector housing body portion 604 permits the wire cables 615 to which the connector 600 is terminated to be arranged vertically, preferably one above another so that the width of the connector is not increased. As noted below, the connector housing 601 is provided with a specially configured rear end in order to reliably grip the cables 615 and hold them in their preferred vertical orientation.

Figure 13:
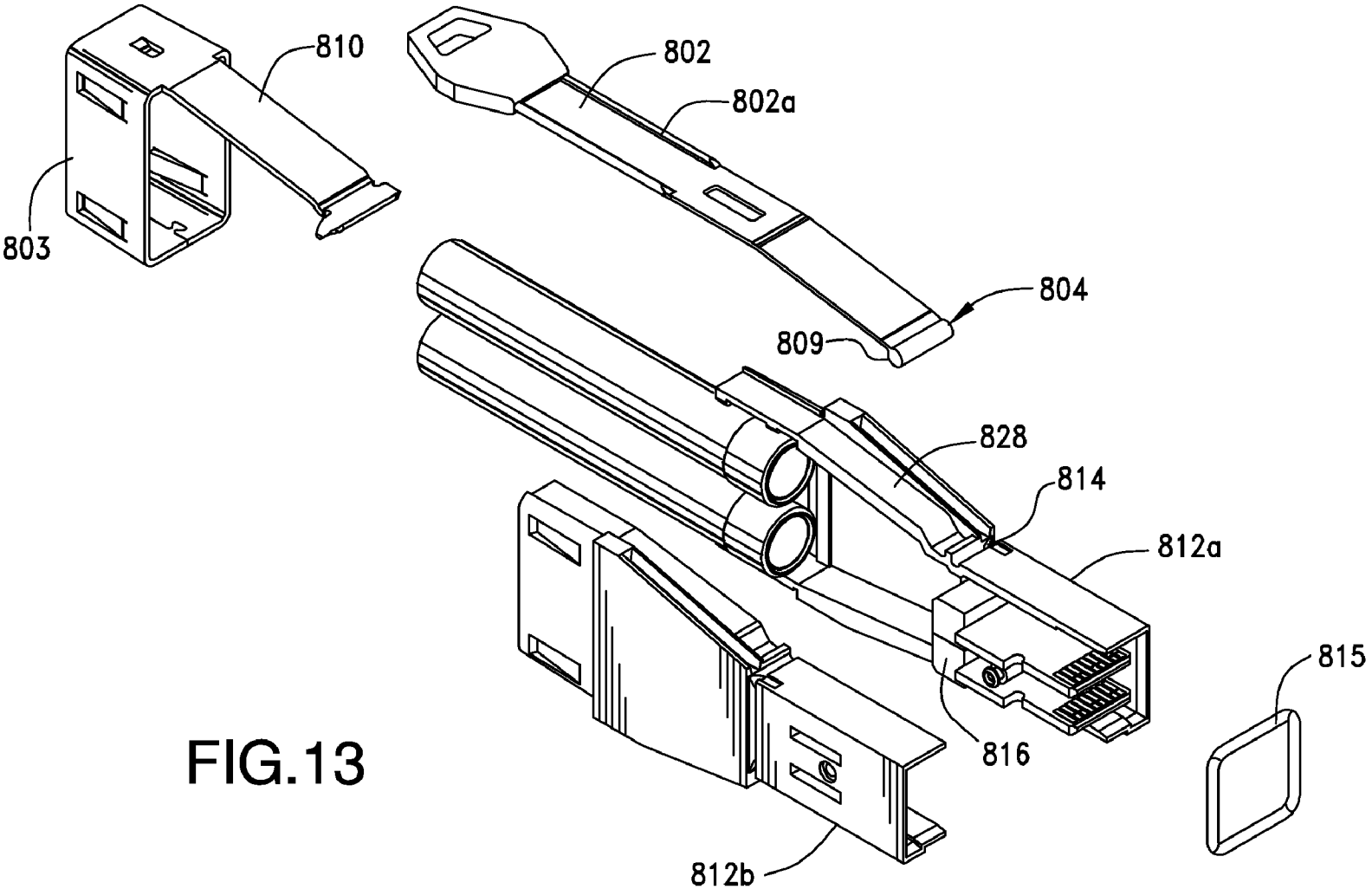
FIG. 13 is the same view as FIG. 12, but with the housing exploded for clarity.
Figure 14:
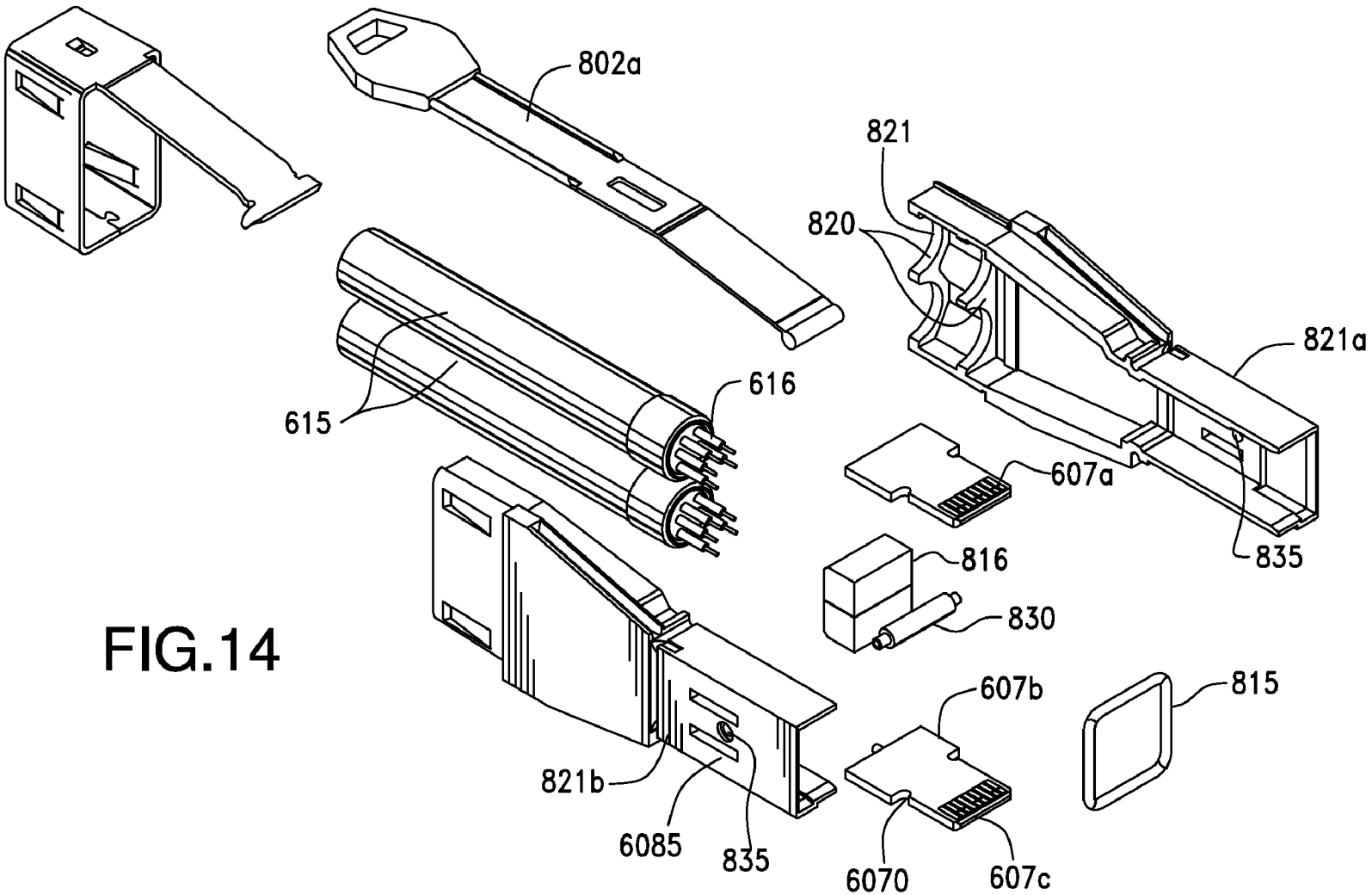
FIG. 14 is an exploded view of the connector of FIG. 13 illustrating the internal components thereof.

The connector housing body portion 604 is larger in size than its adjacent narrow mating portion 605, particularly in the height dimension. As such, the body portion 604 has a greater height than that of the mating portion 605. The interior of the connector housing 601 includes a hollow interior cavity 602, as shown best in FIGS. 7 and 13. The interior cavity 602 occupies most of the connector housing 601, particularly the body portion 604 thereof, but it communicates with the hollow interior recess 606 defined within the connector housing mating portion 605.

The connector housing 601 is formed from two distinct parts, shown as housing halves 610, 611 which are respectively arranged as left and right, or first and second housing halves. If desired, the housing halves 610, 611 may be mirror images of each other. These housing halves 610, 611 are assembled together in the horizontal, or widthwise, direction and are retained together along opposing mating faces by at least two distinct fastening means. The front fastening means 612 is disposed proximate the connector housing mating portion 605, while the rear fastening means is preferably disposed at the connector housing body portion. It can be appreciated from the Figures, both fastening means apply a retaining force on the connector housing 601 that maintains the first and second connector housing halves 610, 611 thereof together in mating engagement. This retaining force is desirably a compressive, or clamping force. In any event, the two fastening means force the two connector housing halves into contact with each other along opposing vertical mating faces that extend longitudinally through the connector housing 601. As shown in the embodiment of FIGS. 1-7, the mating faces are aligned along a vertical axis and are coincident with a longitudinal centerline of the connector, but it will be understood that such a mating line may be offset, i.e., the bottom edge of the first connector housing half 610 may extend further than the edge shown thereof.

Figure 7:
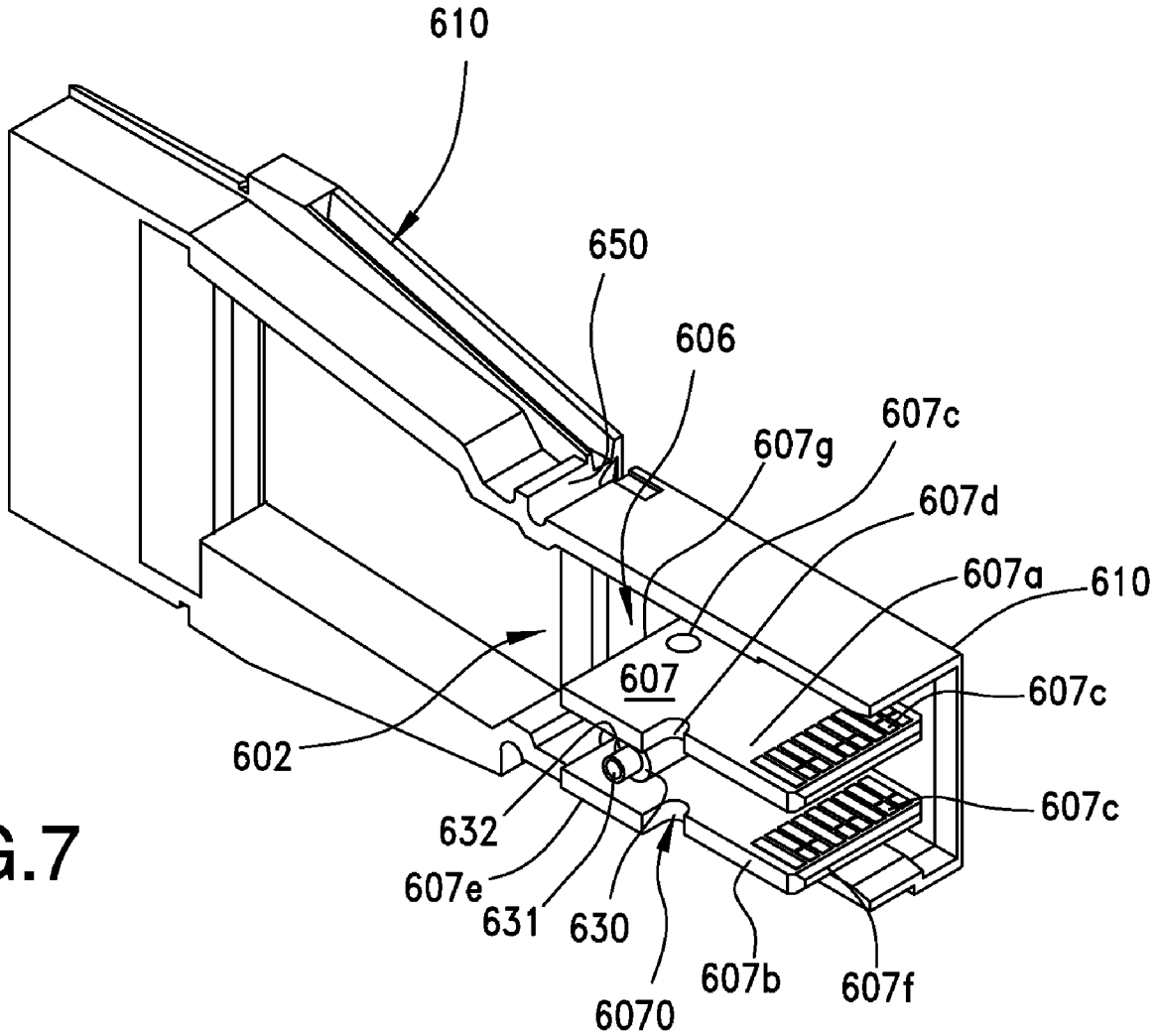
FIG. 7 is a partially exploded view of the left side of the connector housing of the connector of FIG. 1.

In order to apply the desired retaining force at the mating portion 605 of the connector, the front fastening means may include a horizontally extending fastening post 630. (FIG. 7.) This post may be cylindrical or square. The housing halves lend themselves to being easily manufactured by a casting process and as such, the fastening post 630 may be integrally cast with one of the housing halves 610. The post 630 shown has a narrow swaging lug 631 at its free end 632 that is preferably received in a corresponding opening 633 formed in the opposing connector housing half 611. When the housing halves are assembled together, the lug 631 is swaged, or dead-headed within the opening to effect a connection. In an embodiment the post 630 can be integrally formed with one of the housing halves 610 for ease of manufacture and assembly, although alternatively, separate fastener members, such as a screw and threaded boss, or a rivet may be used.

In the embodiment illustrated, the front fastening means 612 is preferably located in the vertical, intervening space that is disposed between the two circuit cards 607*a*, 607*b* and advantageously, does not increase the overall height of the connector housing mating portion 605 but takes advantage of the space used to separate the two circuit cards 607*a*, 607*b*. The circuit cards 607*a*, 607*b* have contact pads 607*c* arranged along their leading edges 607*f* for connection to terminals of an opposing mating connector and along the trailing edges 607*g* for connection to wires 616 of the cables 615 terminated to the connector. As seen in FIG. 7, locating the front fastening post 630 between the two circuit cards 607*a*, 607*b* also permits the post 630 to act as a stop that limits the extent to which the connector 600 can be inserted into an opposing receptacle connector.

As noted above, the connector housing body portion 604 is larger than the housing mating portion 605, specifically with respect to its height. This is important in that it permits the cables 615 to be stacked, or arranged vertically, as they enter the body portion at the rear of the connector housing 601. In this manner, the increase in density of circuits in the connector 600 does not result in an increase in the width of the connector. To accomplish this, the connector housing body portion 604 preferably has a configuration of an irregular polygon, with a trapezoidal-type configuration being shown in FIGS. 1-15, although regular polygons such as rectangular bodies or the like may also be used.

The circuit cards 607 may themselves include means for orienting themselves within the mating portion hollow interior 606 and for engaging the housing halves 610, 611. These means can take the form of notches 607*d* that are formed in opposite sides of the circuit cards 607 that receive lugs or columns, (not shown) that may be formed in the inner surface of the housing halves 610, 611. Or such means can also take the form of wings, or tabs 607*e*, that project outwardly widthwise from the body portions of the circuit cards and which may be received in corresponding slots 6085 formed in the connector housing halves 610, 611.

Figure 2:
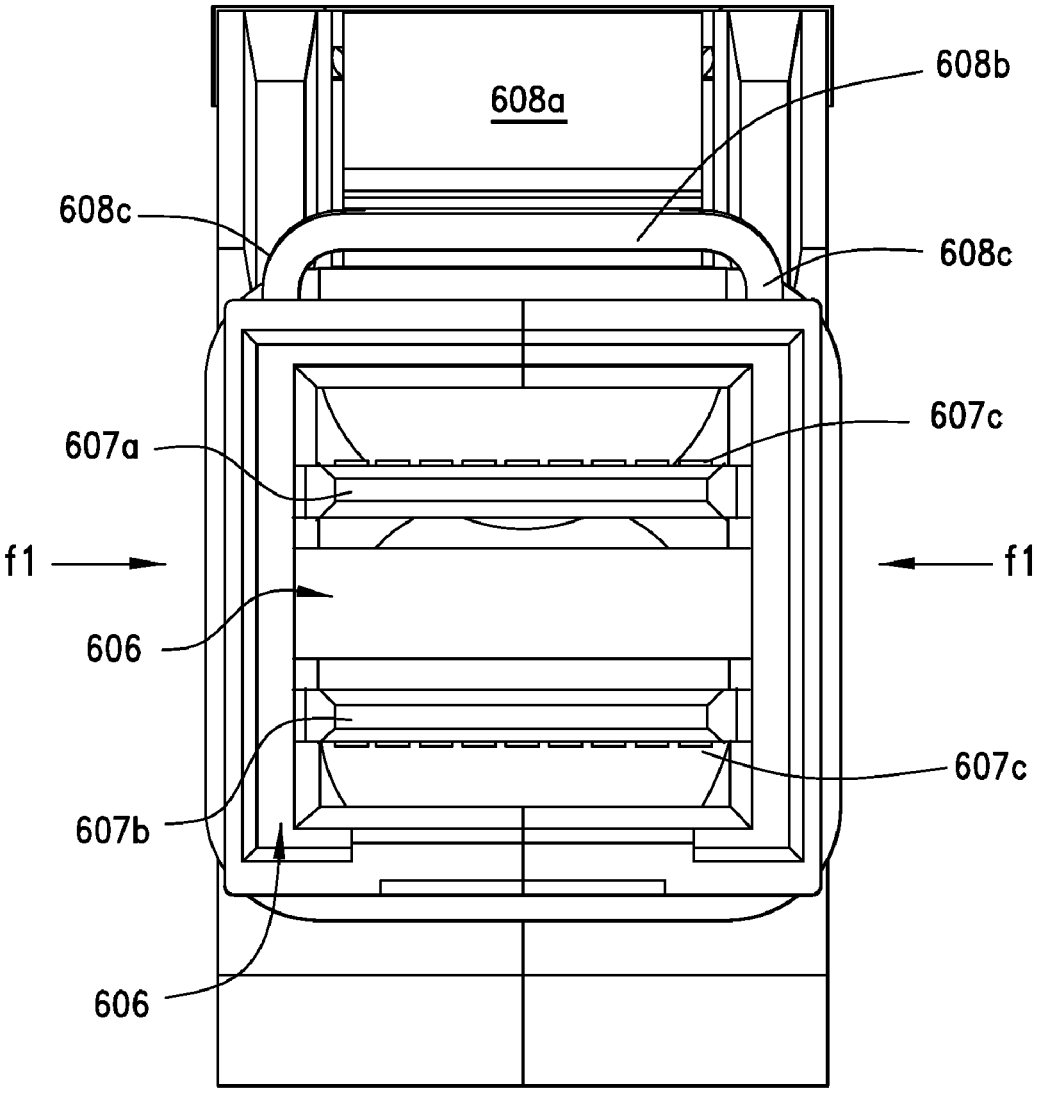
FIG. 2 is a front elevational view of the connector of FIG. 1.
Figure 3:
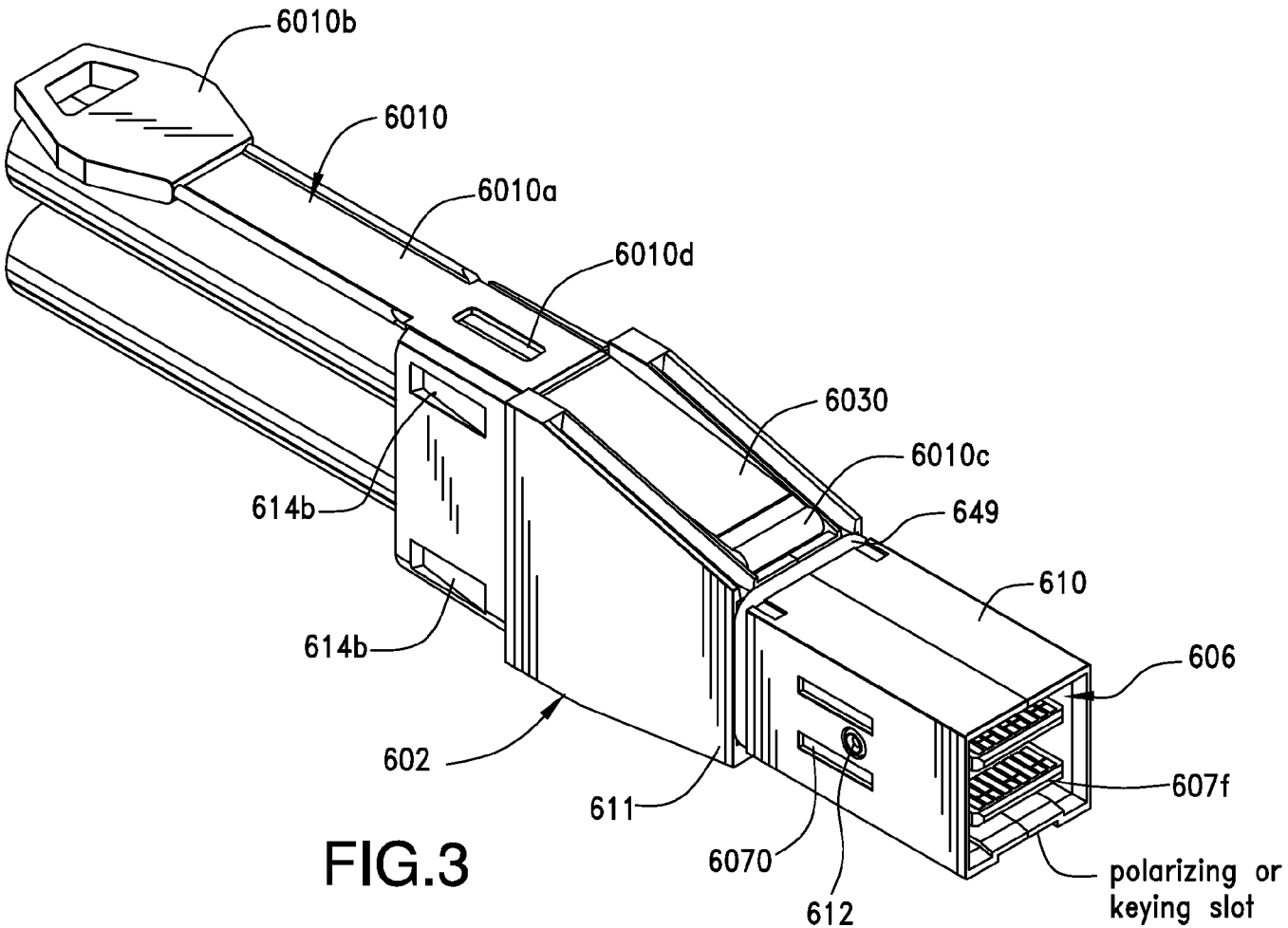
FIG. 3 is the same view as FIG. 1 but with the latching assembly removed for clarity.

As shown in FIGS. 1-3, the connector 600 also may include a manipulatable latching member 608 that has a longitudinal latching arm 608*a* that terminates in a free end 608*b* with a pair of latching hooks 608*c* disposed thereon and spaced apart from each other in the widthwise direction. The general structure of such a latching member is shown in U.S. Pat. No. 7,281,937, issued Oct. 16, 2007, owned by the assignee of the present application and hereby incorporated in its entirety by reference. These latching hooks 608*c* are received in corresponding openings formed in the housing of an opposing mating connector (not shown). The latching arm 608*a* extends longitudinally of the connector body portion 604 and preferably along the top side thereof and has a given lengthwise extent. (FIG. 3.) An actuator 6010 is provided for operation of the latch member and it has an elongated, longitudinal body portion 6010*a* that has a pull or push tab 6010*b* at one end thereof and a cam surface or member 6010*c* at the opposite end thereof. The actuator body portion 6010*a* may include a guide that serves at least to partially retain the actuator 6010 in place on the connector 600 and this guide is shown in the Figures as a slot 6010*d* that engages a lug or the like formed on either the connector housing body portion 604, or as shown in the drawings, a lug 608*e* that is formed on the latching member 608 on the collar portion 608*d* thereof.

Figure 4:
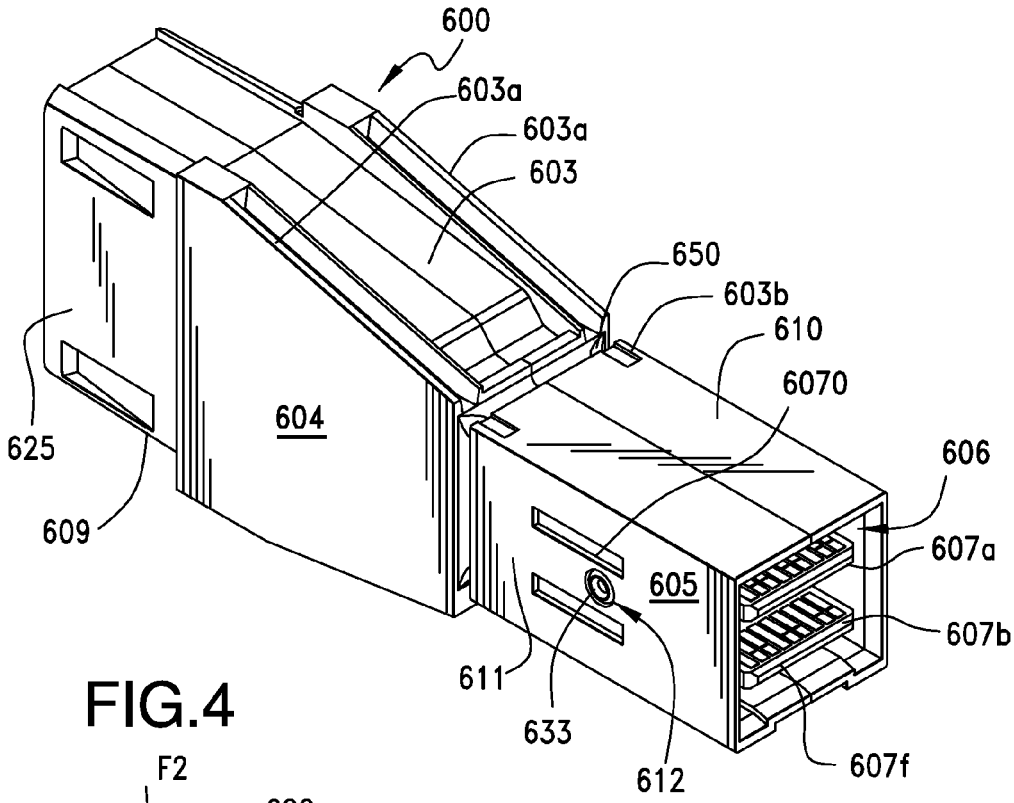
FIG. 4 is the same view as FIG. 3, but with the actuator and cables removed for clarity.
Figure 5:
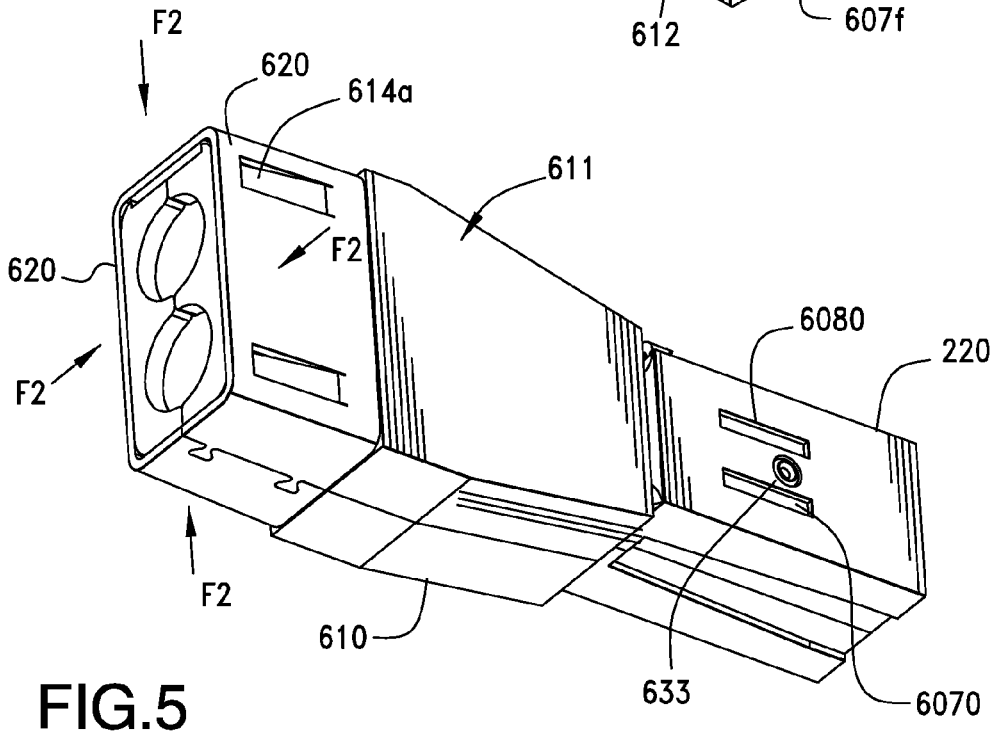
FIG. 5 is a rear perspective view taken from the underside of the connector of FIG. 3, with the cables and actuator removed for clarity.

A shown in FIG. 4, the connector housing body portion 604 includes an inclined, or ramped surface 603 that leads from its top downwardly toward the connector housing mating portion 605. This ramped surface 603 is bordered by a pair of upstanding side rails, or ribs, 603*a* that define a longitudinal channel in which the latching arm 6080*a* of the latching member 608 is received. The connector housing mating portion 605 has two openings 603*b* formed therein as recesses which are disposed proximate to the side edges of the mating portion. These openings 603*b* receive the latching arm engagement hooks 608*c* when the connector 600 is mot mated to an opposing device. When mated, these openings receive the ends of the engagement hooks 608*c* that extend through the mating holes of the opposing connector.

In this embodiment, the rear fastening means 620 not only applies a retaining force to the two housing halves 610, 611, but it also holds the latching member in place on the connector housing without the use of rivets, screws or other type fasteners that require labor for assembly. The rear fastening means 620 takes the form of a retainer that preferably includes a collar portion 621 that at least partially, encircles, and preferably entirely encompasses, the exterior perimeter, or circumference of the connector body portion 604 near the trailing, or proximal end of the connector 600. The collar portion 621 slips over the body portion 604 and preferably in the form of an interference fit, engages the housing body portion 604 in a manner so as to press the two housing halves together along their opposing mating faces.

Figure 6:
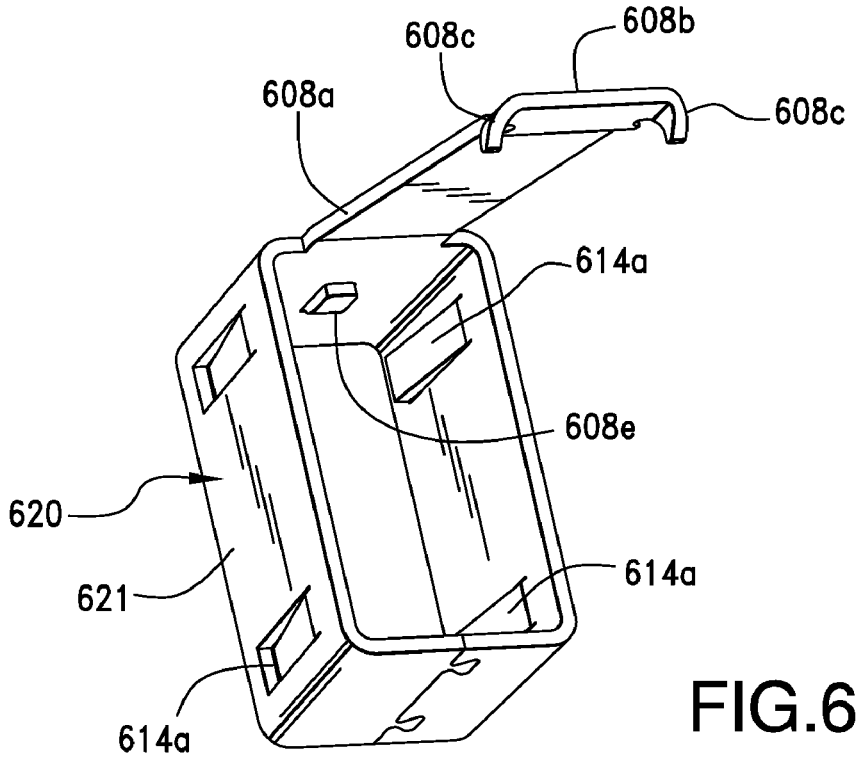
FIG. 6 is a perspective view of the latching assembly of the connector of FIG. 1 taken from the lower front end thereof, and having the form of a continuous retaining collar.
Figure 6A:
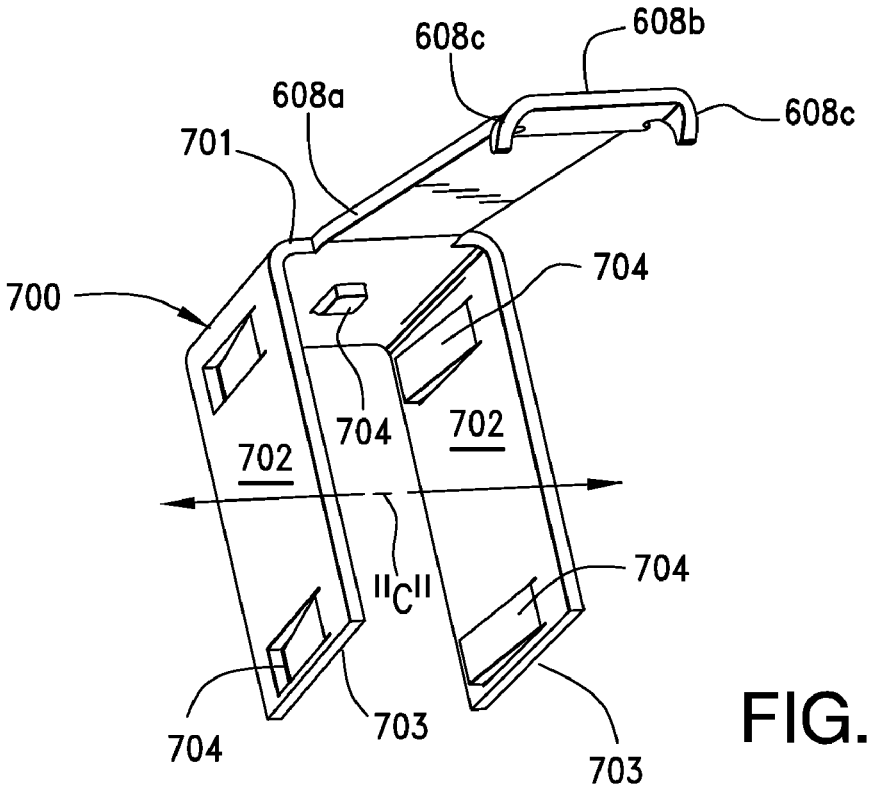
FIG. 6A is a perspective view of another embodiment of a latching assembly, wherein the latching assembly retainer has a U-shape with an open end.

As shown in FIG. 6A, one type of retainer 700 may have a general U-shape with a backbone portion 701 and two leg portions 702 that terminate in free ends 703. Engagement members 704 may be stamped, or otherwise formed, in the retainer 700 in order to 514*b* engage recesses 614*b* formed on the connector housing 601 and particularly in the housing channel 625. The retainer engagement members 704 are shown arranged proximate the free ends 703, proximate the junction of the backbone portion 701 to a leg portion 702 and on the backbone portion itself. The length of the leg portions 702 in such that the retainer 700 will desirably contact more than one-half of the circumference connector housing so that this style of retainer will exert a clamping force on the two connector housing halves 610, 611. This length should extend past the line "C" shown in FIG. 6*a* which is the midpoint of the leg portion length.

The rear fastening member engages the connector housing in a circumferential manner, meaning it engages enough of the circumference to exert a clamping force on the two housing halves 610, 611. The term "circumference" as used herein is equal to "perimeter", and means a chosen extent around the outer surfaces of the connector housing 601, whether or not it is circular or cylindrical in shape. As noted, this will typically require that it extend on the connector housing more than one-half of the circumference, or perimeter, but it will be noted that in square or rectangular housings, engagement of three of the four sides, will provide a clamping force. It is preferred, as shown in FIG. 6A that the retainer leg portions have at least some engagement members 704 near their free ends. The retainer 700 of FIG. 6A engages not only the two opposing connector housing halves 610, 611, but also three adjacent sides of the connector housing 601, namely the left, top and right sides.

Figure 6B:
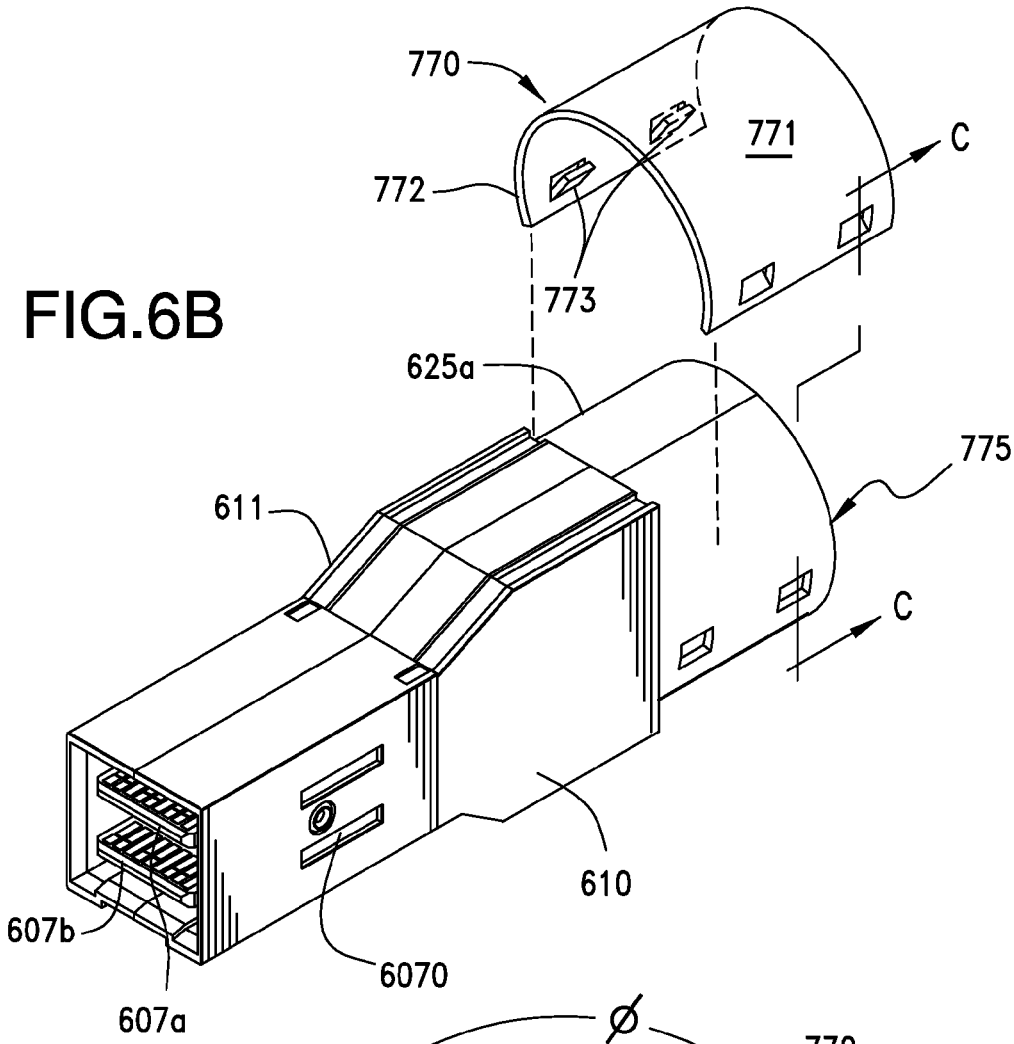
FIG. 6B is a perspective view of another embodiment of a retainer which has a general C-shape, with two free ends.
Figure 6C:
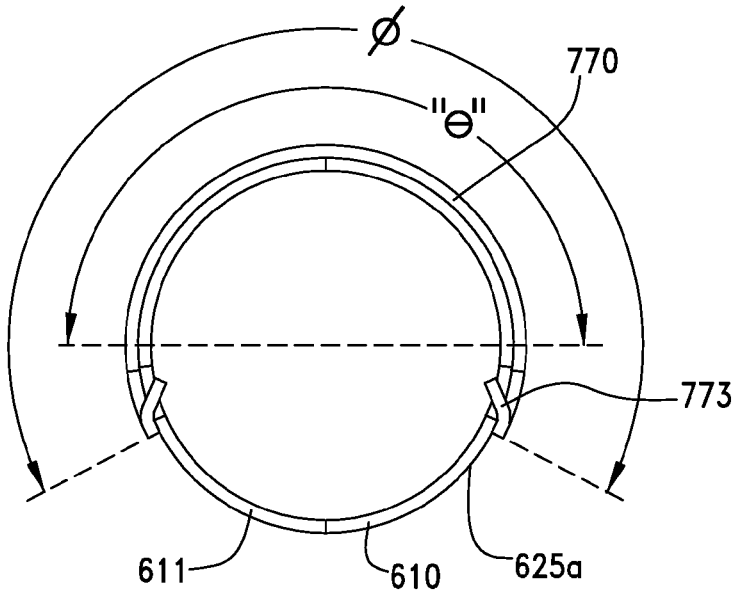
FIG. 6C is a sectional view of FIG. 6B, taken along lines C-C thereof.

Other retainers may also have a more rounded C-shaped configuration, rather than the rectangular and U-shaped configurations illustrated. As illustrated in FIGS. 6B and 6C, the retainer 720 can have a semi-circular or general C-shape with a backbone portion 771 from which extends two arm portions that terminate in free ends 772. These free ends 772 include engagement members shown in the form of tabs 773 that are punched, or otherwise formed, in the collar 770. In this alternate embodiment, the rear end 775 of the connector housing body portion 604 may be cylindrical and include a channel 625 in which the retainer 770 is received. The retainer 770 engages the part of circumference of the connector housing 601, i.e. its outer perimeter, and in order to apply a retaining face to the connector housing halves 610, 611, the arc length "ø" of it (or its length of engagement from one free end to the other) should be greater than 180° (or more than one-half the outer perimeter) as shown diagrammatically in FIG. 6C. One can see the extent to which the free ends 772 extend past the halfway point, represented by "θ" in FIG. 6C.

In all of the embodiments, it is preferred that the connector housing body portion include a recess, or channel 625 that extends around the perimeter of the body portion to define a channel that receives the retainers 620, 700 or 770. The channel 625 preferably has a depth that is greater than or equal to the thickness of the retainer so that the retainer may be flush with respect to the connector housing outer surface(s) so as to maintain the desired size of the connector. As can be appreciated in FIGS. 3A & 3B, the rear channel 625 is tapered in the widthwise direction. This taper is an inwardly taper that extends at an angle "AC1" from the point where the channel meets the connector housing body portion 604 and it cooperates with the overlying retainer to provide a desirable clamping force to the connector housing, as explained in more detail below.

The first fastening means can be seen to apply a linear fastening force horizontally along the lines F1 in FIG. 1, while the second fastening means applies a circumferential force along the lines F2, in the horizontal and vertical directions along the lines F2 in FIG. 1.

Figure 3A:
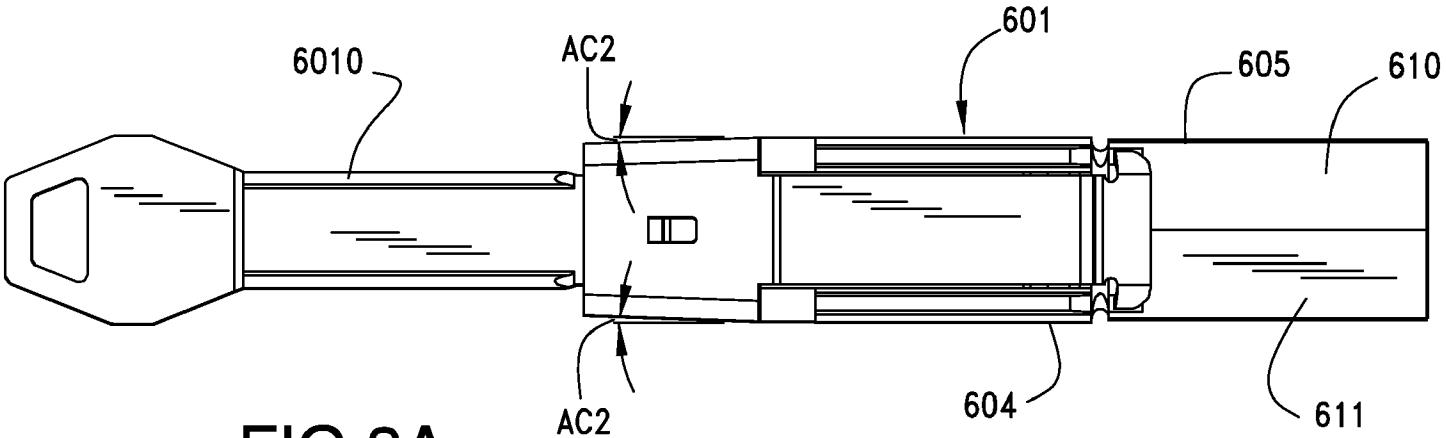
FIG. 3A is a top plan view of the connector of FIG. 3.
Figure 3B:
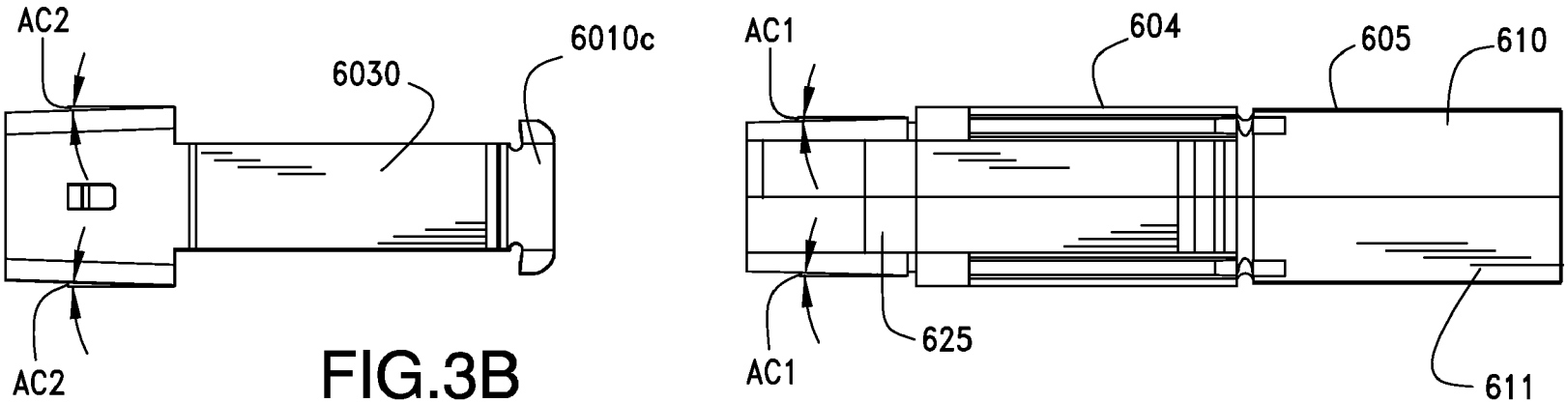
FIG. 3B is the same view as FIG. 3A, but with the actuator removed and latch member spaced away from the connector housing for clarity.

The retainers 620 of the connector are also tapered, with an inward taper in the widthwise direction at an angle "AC2" from a datum line as shown in FIGS. 3A & 3B. In order to provide a reliable interference fit and a widthwise clamping force that holds the cables in place and the housing body portions together and provides support for the cantilevered latching arm 608*a*, it is preferable that the taper angle AC2 of the retainer be greater than the taper angle AC1 so that the collar portion 621 of the retainer 620 elastically deforms slightly so that it undergoes tension while exerting a compressive force on the two housing halves 610, 611. This same compressive force mating arrangement may be provided by utilizing means other than tapers, such as by a difference in exterior overall diameter, or perimeter, of the connector housing 604 and the overall interior diameter, or perimeter, of the collar portion 621, as well as by other means.

The collar portion 621 may have engagement tabs 614*a*, formed therein, such as by stamping. These engagement tabs 614*a* are preferably formed as illustrated, on opposing extents of the retaining collar and four such tabs 614*a* are illustrated disposed proximate to corners of the retaining collar. Although illustrated as formed in the vertical wall portions thereof. The engagement tabs 614*a* may also be formed in the horizontal wall portions thereof. It is preferred that these engagement tabs 614*a* are disposed on opposite sides of a longitudinal centerline of the connector housing.

The engagement tabs 614*a* assist in retaining the collar portion 621 on the connector housing body portion 604. The connector housing body portion 604 includes a plurality of recess, or slots 614*b* that are formed in the outer surface thereof and these recesses correspond in number to the slot of the engagement tabs 614*a* such that a single engagement tab is received in a single recess 614*b*. The recesses 614*b* have shoulders 618 that serve as stop surfaces against which the engagement tab free ends 619 bear. This confronting relationship serves to retain the collar in place within the channel proximate to the end of the body portion 604. As shown in FIG. 4, the recesses 614*b* may have a variable depth, which increases toward the rear of the recess at the shoulder 618. This interference retains the collar in place on the connector housing and prevents it from being disengaged when the connector is connected or disconnected from a device.

In this regard, the retainer 620 may be considered as affixed to the connector housing in as much as to remove it, one would need to pry it off or apart. Also advantageously, the retainer has a construction that permits it to be press fit over the connector housing, requiring only one assembly step as opposed to the use of rivets or screw-type fasteners, which require multiple labor steps. The retainer therefore also serves to fixedly attach the latching member 608 to the connector housing 601 so that the latching arm 608*a* thereof is fully cantilevered. As shown in FIG. 6, the engagement tabs 614*a* are disposed proximate to the corners of the retainer 621. As shown in other embodiments, they are located at least proximate to the free ends of the retainer.

FIGS. 8-15 illustrate a tandem style connector 635 constructed in accordance with the principles of the present invention. In this embodiment, a center piece 640 is provided and mates with the left and right housing halves 610, 611 to increase the size of the connector, widthwise and to provide a pair of hollow mating portions 605 that extend out from the body portion 604. Each mating portion 605 contains a pair of circuit cards 607*a*, 607*b*, 607*a*' and 607*b*'. Not only is it preferred that the circuit cards in each pair be parallel (i.e. lie in parallel planes), but it is also preferred that the circuit ends of the two different pairs lie in respective planes (i.e. cards 607*a* and 607*a*' lie in the same place, while cards 607*b* and 607*b*' lie in another plane), meaning the circuit cards of each pair live in this different, parallel planes and the circuit cards of each pair are coincident with their counterparts in the other pairs.

Figure 8:
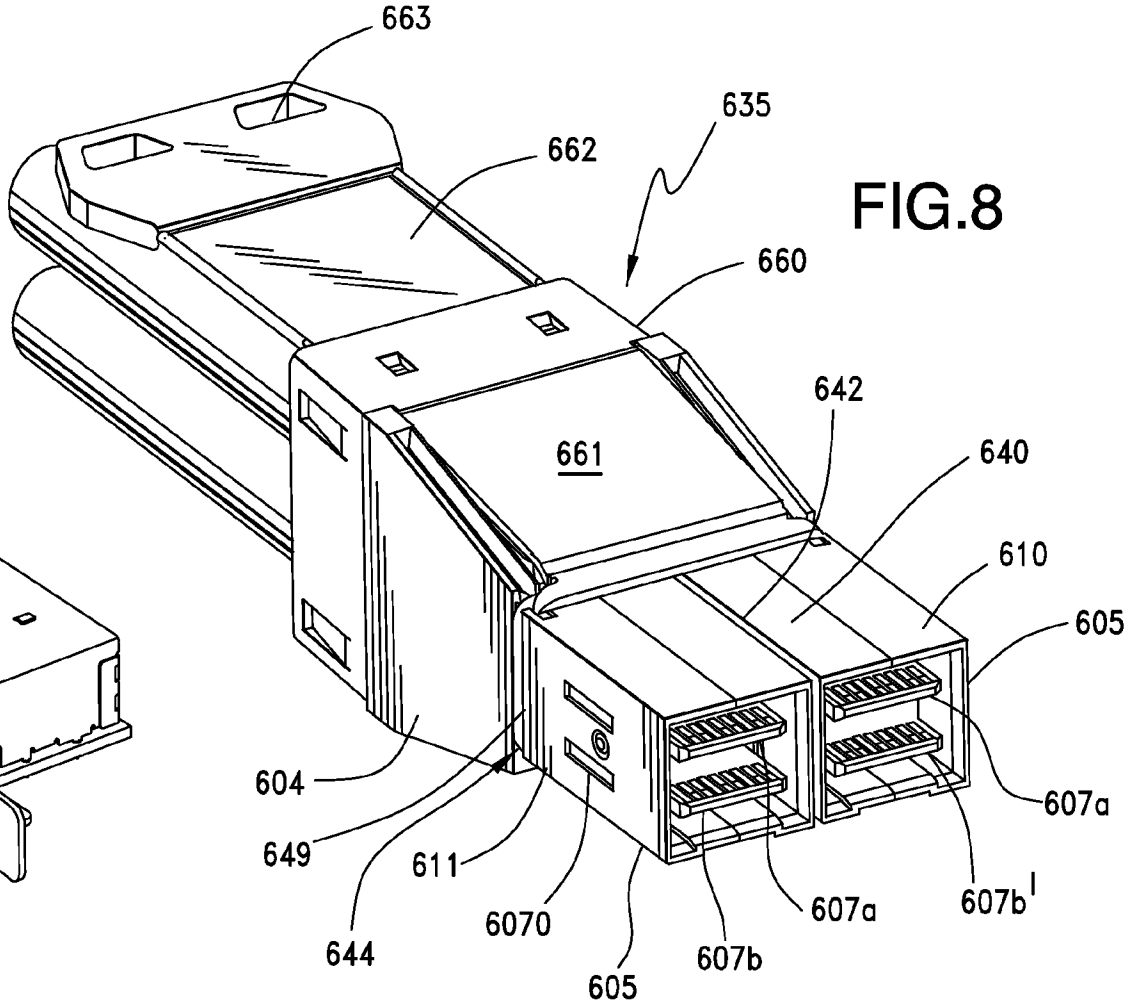
FIG. 8 is a perspective view of an embodiment of a tandem connector.
Figure 8A:
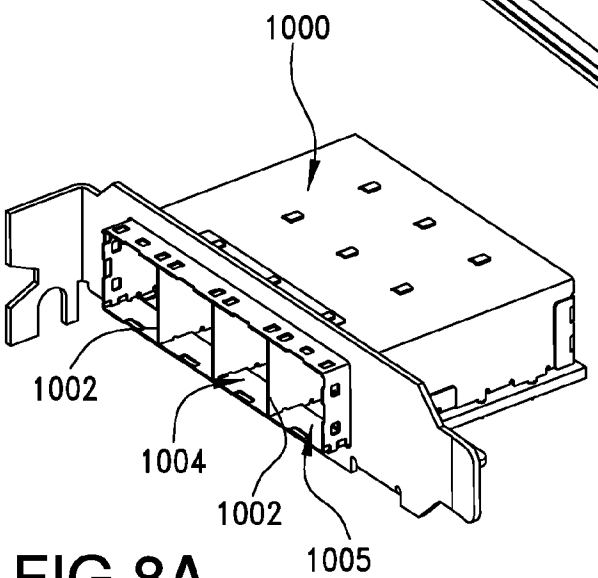
FIG. 8A is a perspective view of a 1×4 receptacle connector assembly with which the tandem connector of FIG. 8 mates.
Figure 9:
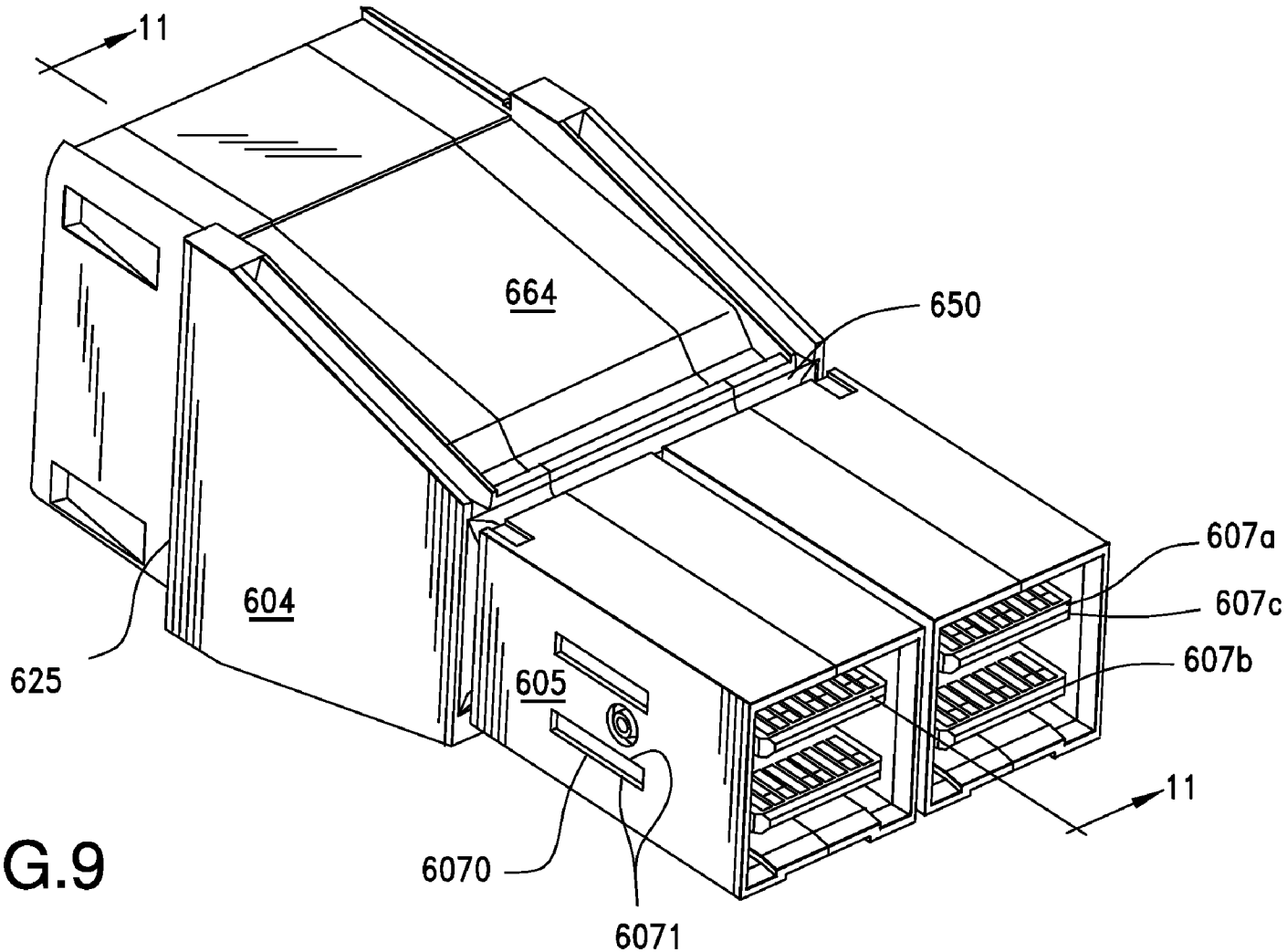
FIG. 9 is the same view as FIG. 8, but with the cables and latching collar removed for clarity.
Figure 10:
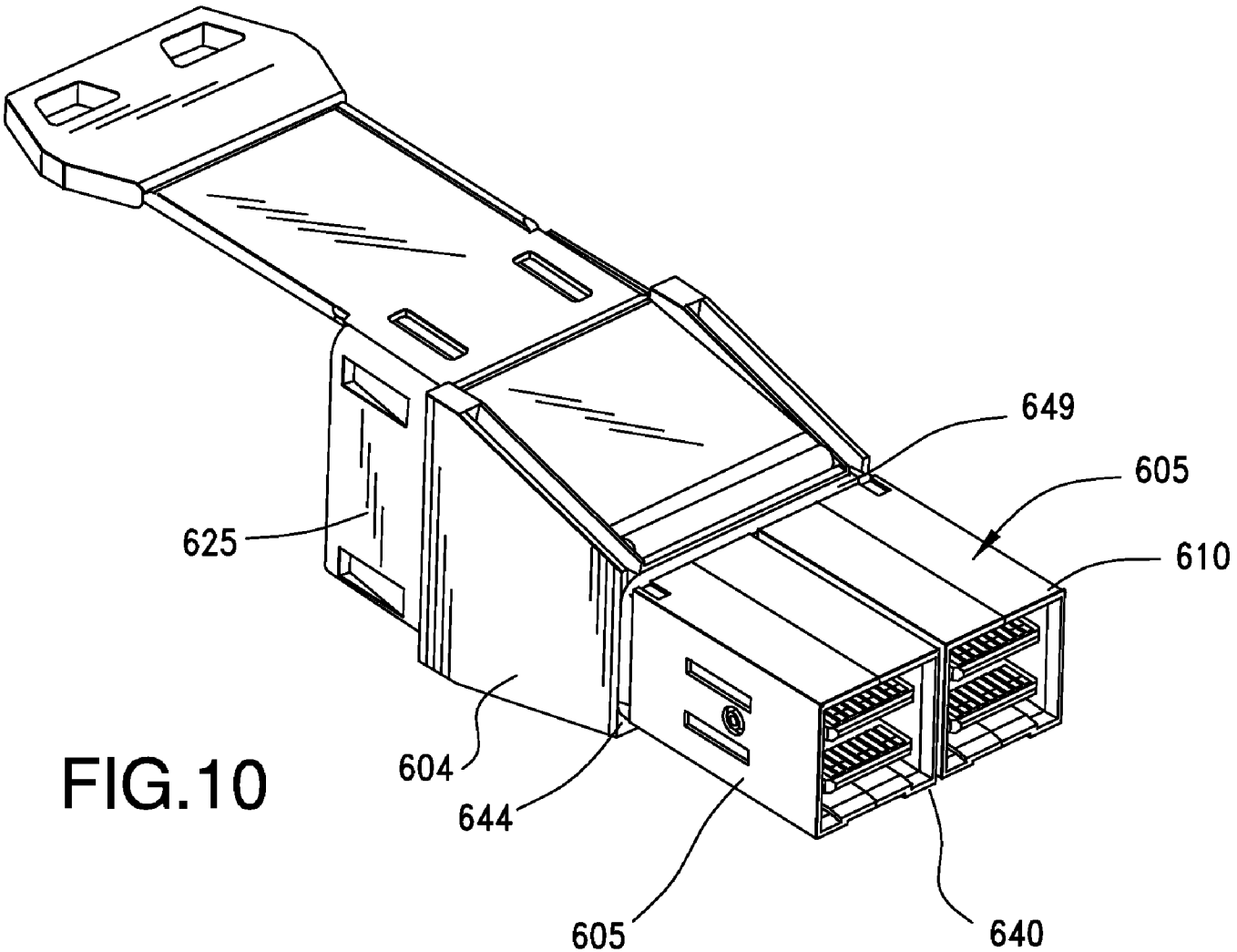
FIG. 10 is the same view of FIG. 9, but with the actuator illustrated in place upon the connector housing.

The two mating portions 605 are separated by an intervening slot 642 that extends rearwardly from the front edges thereof to the front wall 644 of the body portion 604. This slot 642 permits both mating portions 605 to be hollow enclosures, with sidewalls 646 and top and bottom walls 647, 648, respectively, but it also serves other purposes. For example, the multi-functional slot 624 can receive a dividing wall 1002 that separates two adjacent hollow connector bays 1004, 1005 of a 1×4 receptacle connector assembly 1000 (FIG. 8A) to which the connector 640 mates, such that the two adjacent mating portions 605 are respectively received within the adjacent bays 1004, 1005. It also provides a channel that receives portions of either a pair of EMI gaskets 649 (FIG. 10) or a two-hole single gasket (not shown). Still further, the slot 642 can provide a slot opposing the free end 633 of the front fastening posts 630, into which a plate can be inserted to act as a reaction surface when swaging the front fastener lugs 631 so that the swaging process does not cause the fastening posts to break through the inner sidewalls 646 of the center piece 640. In addition, center slot 642 also communicates with a peripheral groove 650 that extends entirely around the mating portion(s) and which receives the gasket(s) 649.

In the depicted tandem connector, a latching member 635 is provided that is wider than that of the corresponding embodiment of FIGS. 1-6. Its retaining collar portion 660 is wider as is the latching arm 661 that extends toward and over the mating portions 605. This latching arm 661 is received in a channel 664 that is formed by all three of the housing pieces 610, 642 and 611. The left and right housing halves 610, 611 already have their openings 603*b* formed therein, so no modification is required to the connector housing mating portions 605 of the tandem connector to receive the engagement hooks 665 of the latching arm. The actuator 662 has a wider body portion and the pull or push tab end thereof 663 is also increased in size, preferably doubled. The latching arm 661 extends across both connector housing mating portions 605.

Figure 11:
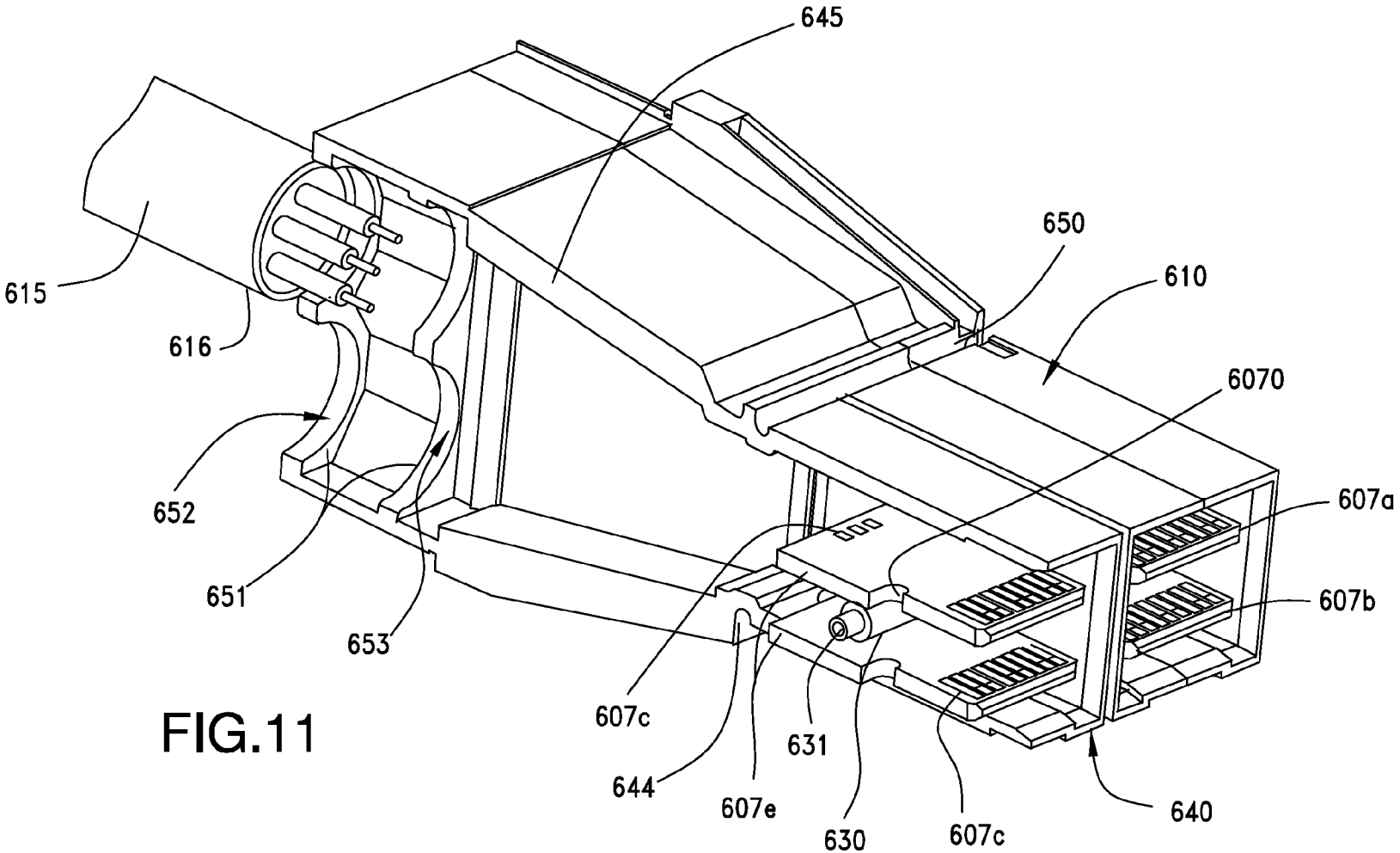
FIG. 11 is the same view of the connector of FIG. 9, but with the right side housing member removed therefrom.
Figure 12:
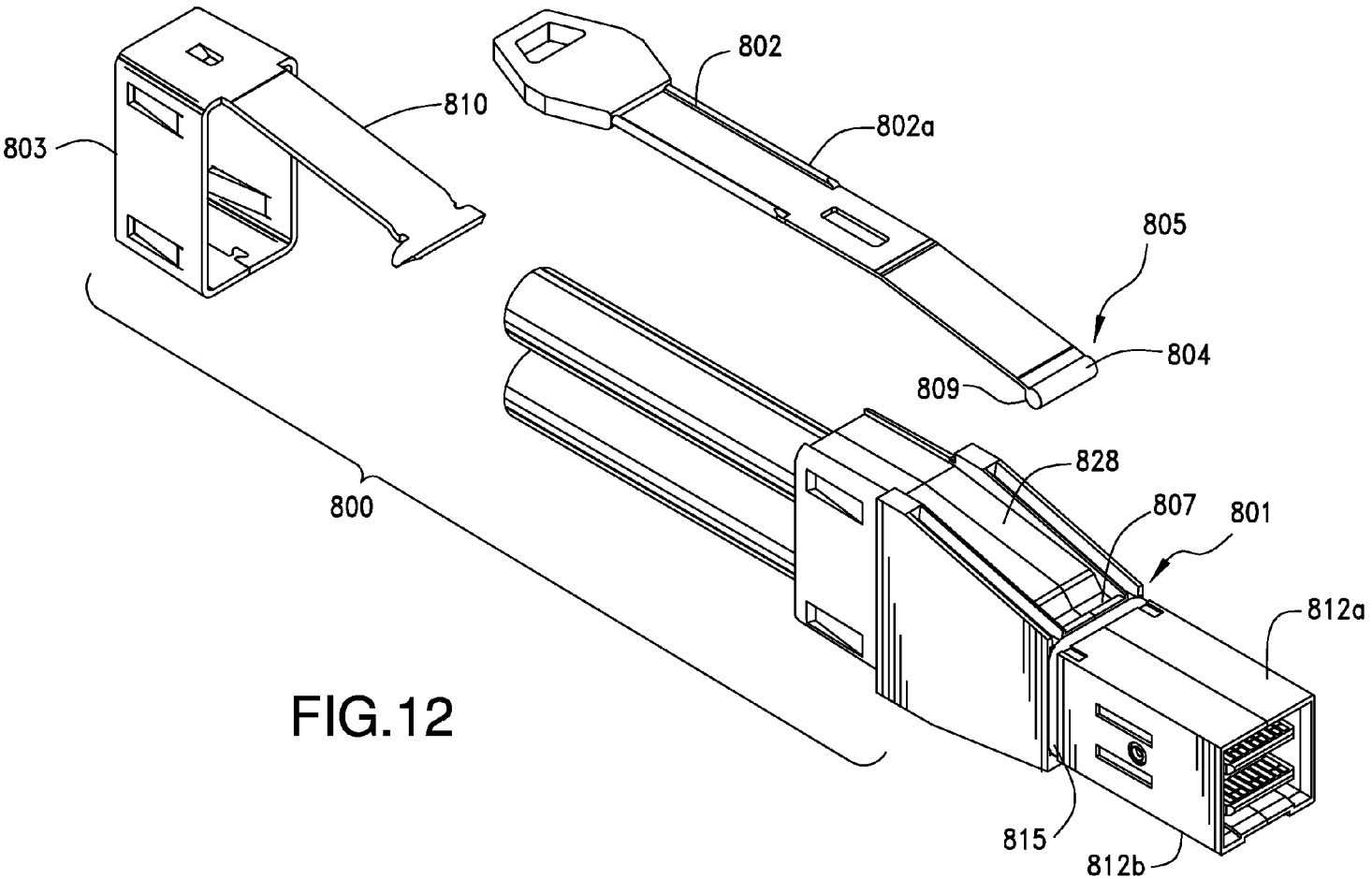
FIG. 12 is a partially exploded view of the connector of FIG. 1, better illustrating the structure of the latching assembly and actuator.

The center piece 640 has opposing mating faces 652 (FIG. 11) that abut against confronting surfaces of the two housing halves 610, 611. The connector housing may be provided with a rear bulkhead 652 that has a plurality of cable support walls 651, each of which contains grooves 653 that are provided to grip the cables 615 and hold them in the desired vertical orientation. The walls 651 are spaced apart from each other to provide measure of strain relief to the wire cables 615. As shown in FIG. 11, it is preferred that the cable groove 653 be aligned with the front fastening posts, meaning that one cable 615 should be located just about above the elevation of the front fastening post(s) 630 and the other cable below. This effectively splits the interior cavity 602 into two equal areas for the cable wires 616 to run to the circuit cards 607*a*, 607*b*. Inasmuch as the cable wires 616 are much smaller than the cables 615. The trapezoidal configuration helps provide more interior space for the wires and circuit cards while keeping the overall size for the connector small.

FIGS. 15-20 illustrates another connector 800 of the invention that utilizes a latching mechanism that is integrated with a connector housing 801, actuator 802 and a latching/fastening collar 803. In this embodiment, the actuator 802 has a pair of ribs 802*a* added to it for stability. It has a cam member 804 at its leading end 805 and the connector housing 801 has a recess 807 that receives the cam member 804. The cam member 804 is shown in the form of a cylindrical roll pin 809, although other shapes may be used. Both the actuator 802 and the latching collar latching arm 810 are received within a channel formed in the top of the connector housing 801.

In operation, with this embodiment as well as with the other described embodiments, the user typically pulls the pull tab portion of the actuator 802 rearwardly. This causes the cam member 804 to be pulled up and out of its recess 807 and along the ramped surface 828 upwardly, where it contacts the underside of the latching arm 810 of the latching member 803, thereby raising it in the same manner of operation as explained in the aforementioned U.S. Pat. No. 7,281,937. The horizontal pulling movement of the pull tab is converted into a vertical movement of raising or lowering the free end of the latching arm. Similarly, the same connector and principles of operation can be used to raise the latching arm for purposes of latching and unlatching the latching member with an opposing device by a pushing movement on the actuator. In this case, the actuator is preferably made of a rigid material so that it does not flex when it is pushed forwardly from the rear end of the actuator. This forward movement drives the cam member into contact with the underside of the latching arm, and due to its inclined configuration, which follows that of the connector housing ramped surface. This movement and contact results in the raising of the latching arm. In this type of structure, the cam member at the free end of the actuator may include a flat free end of the actuator or it may include an enlarged member.

The two housing halves 812*a*, 812*b* are joined together along a line that is coincident with the housing centerline and it will be understood that the top and bottom portions of this mating may be offset so as to provide another measure of interfitting. The housing 801 may be grooved at 814 to receive an elastomeric or other style gasket 815 for EMI reduction. The housing may contain one or more blocks 816 that serve as stops for the circuit cards 607 or as premolded supports for free ends of the wires (not shown) exiting the cables 817. This embodiment also utilizes an insulator fastening post 830 that has two opposing ends, each with a swaging lug 833 disposed thereon. The post 830 is inserted between the mating portion sidewalls of the connector 800 so that their lugs 833 extend through corresponding holes 835 in the sidewalls and then both lugs are swaged.

FIGS. 15-20 illustrate another embodiment of a tandem connector 850 that has a retaining collar 851 with a latching arm 852 also of a longer width. The latching arm 852 has an expanding extent in that its width grows from a narrow width at $w_1$, at the top of the latching arm to a wider width of $w_2$ at its free end 853 as shown best in FIG. 16. The narrow upper part of the latching arm facilitates operation of the latching member and serves to reduce the pull or pushing force required.

Figure 20:
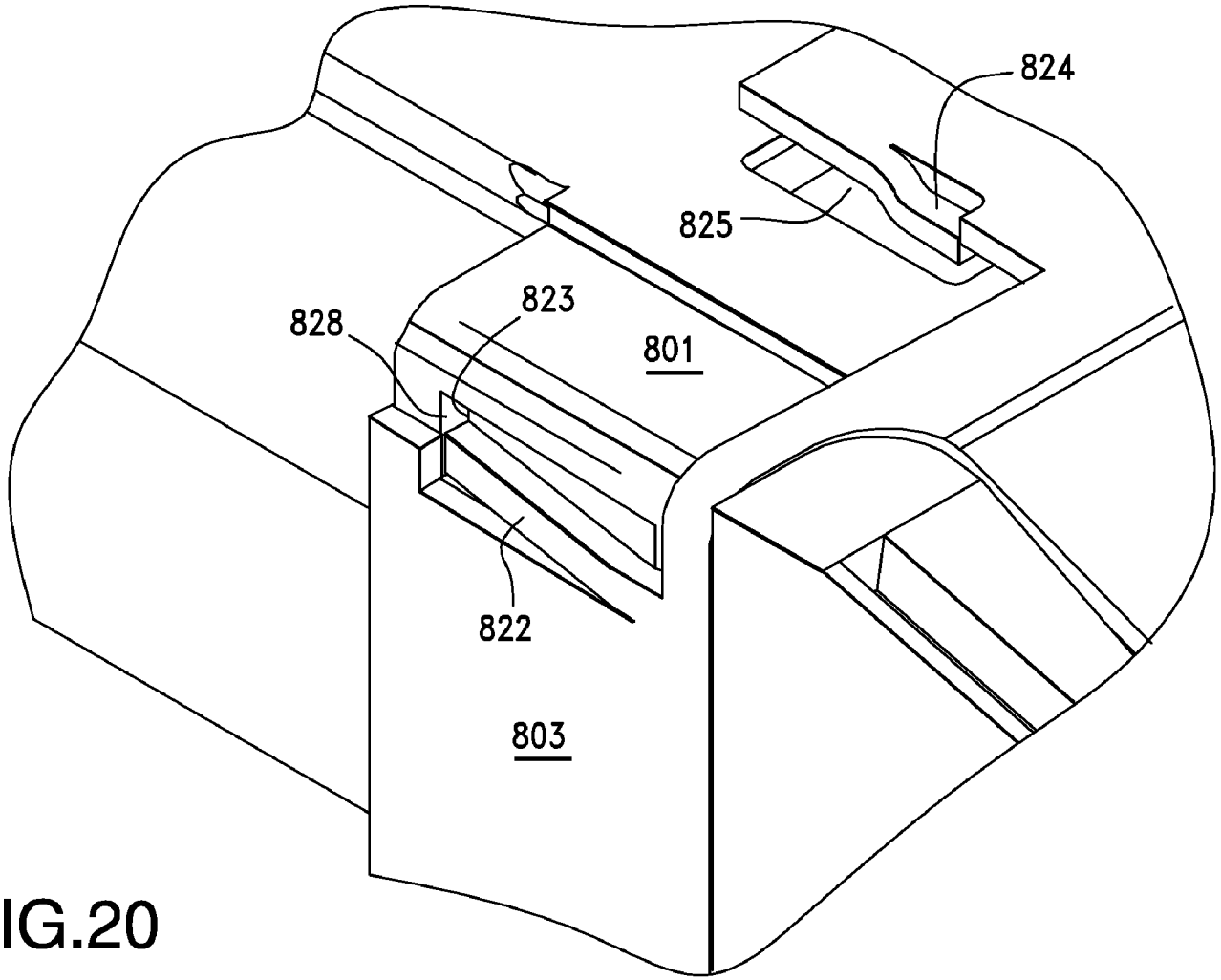

As can be seen in FIG. 20, the retaining collar 851 is stamped and formed as evidenced by its manner of construction. The entire assembly is stamped from a single sheet of metal. The stamped part has two free ends 854 that are joined together by a dovetail arrangement 856.

As in the other tandem embodiment, the front fastening members 612 are shown as interposed between the top and bottom circuit cards 607*a*, 607*b* and two such fasteners in the form of posts 630 are used to hold the housing halves together at the nose portion.

With this type of horizontal structure, cost of assembly as well as inventory of parts can be reduced. The right and left housing halves are preferably minor images of each other so that in order to assemble multiple bay connectors only right, left and center prices are required to form a two bay tandem-style connector. Additional bays may be added by using additional center pieces. For example, two center pieces and a right and left piece can be combined to form a three bay plug connector. Additional center pieces can be used to expand the number of mating portions and the number of bays (mating portions) will always be one more than the number of center pieces.

The trailing edge of the housing 801 is slotted and provided with pairs of ribs 820 that are configured to grip the ends of the cable 817 in two places. The ribs 820 are configured with recesses 821 that are preferably complementary to the cable shape.

Figure 15:
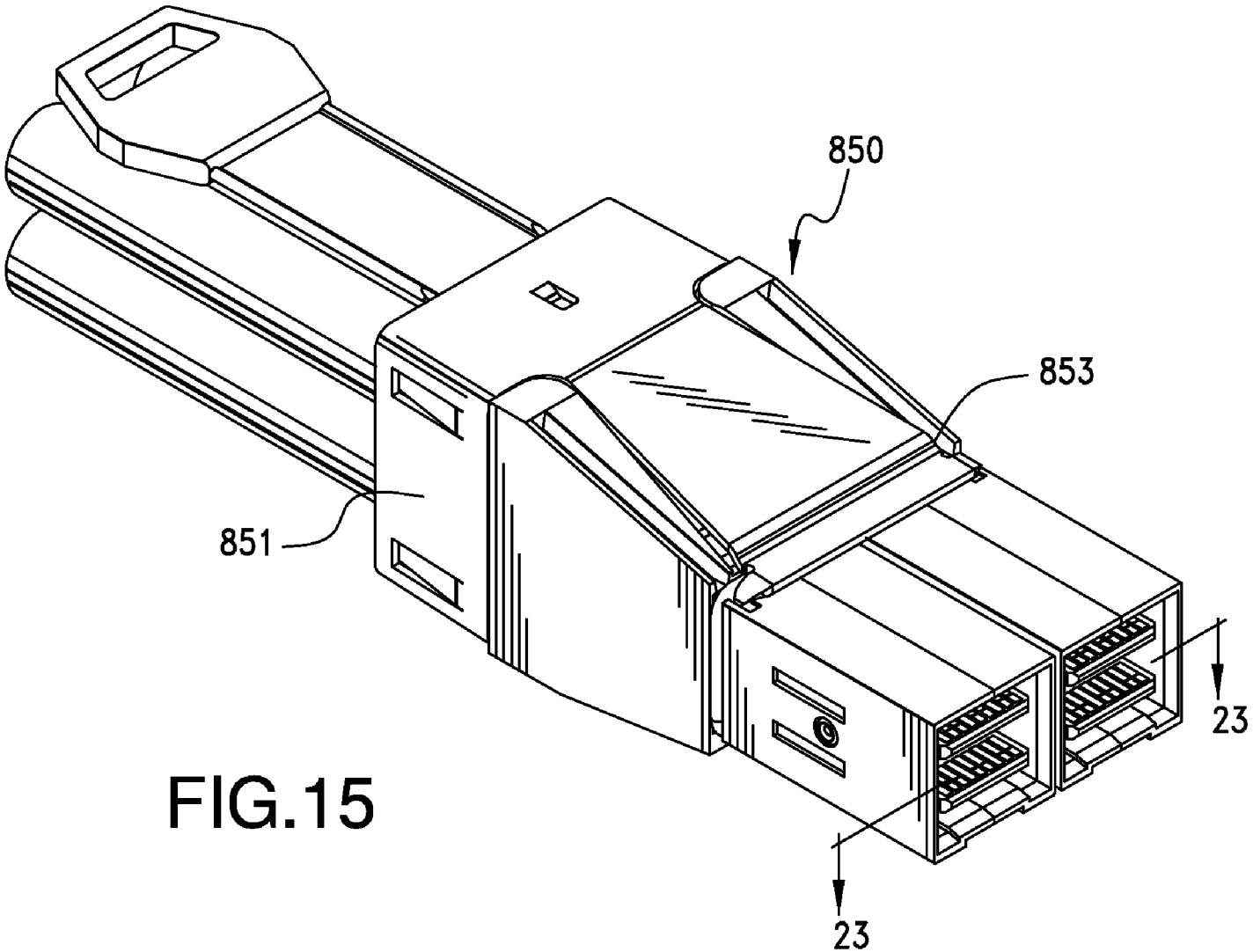
FIG. 15 is a perspective view of another embodiment of a tandem connector.
Figure 16:
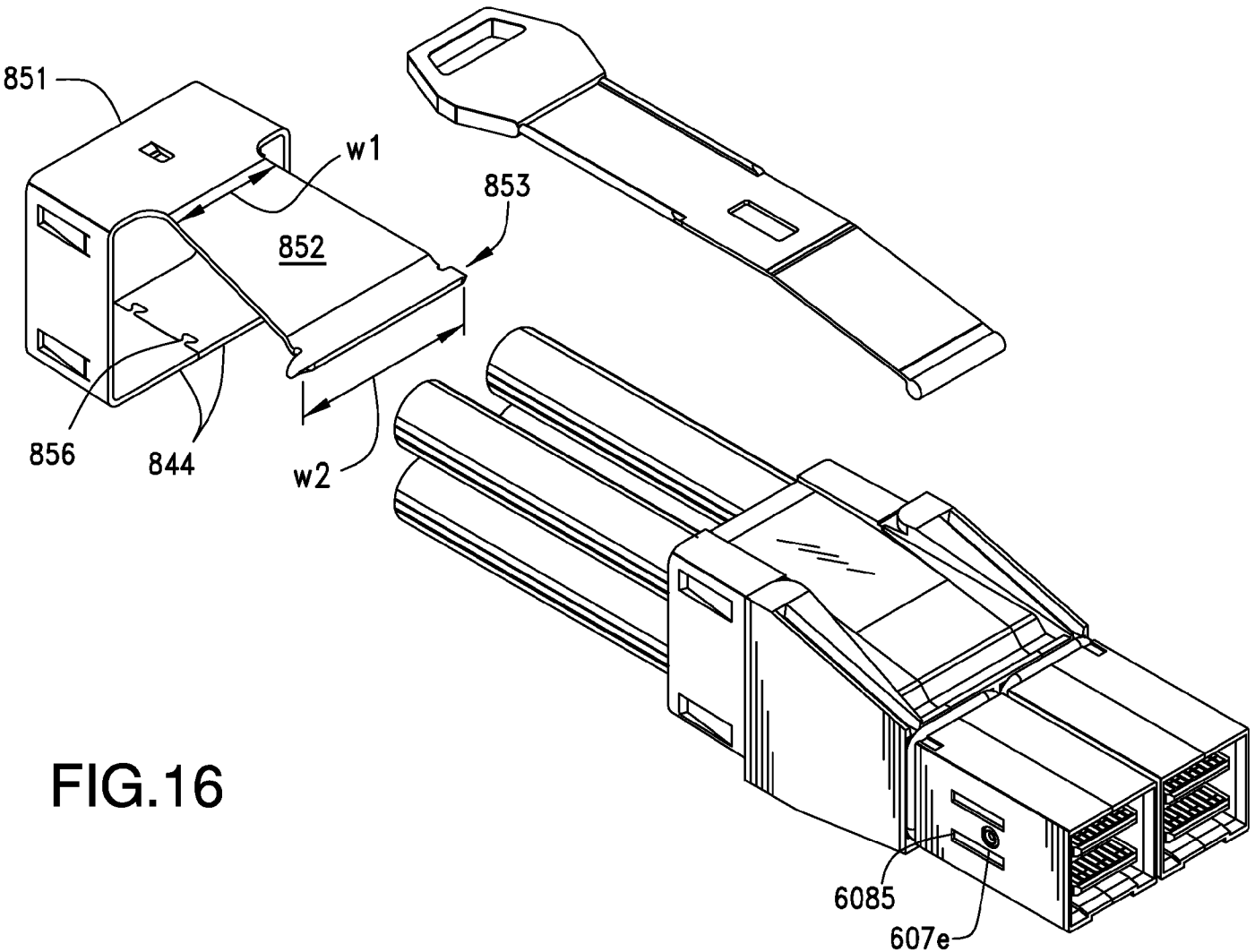
FIG. 16 is the same view as FIG. 15, but with the latching assembly and actuator removed for clarity.
Figure 17:
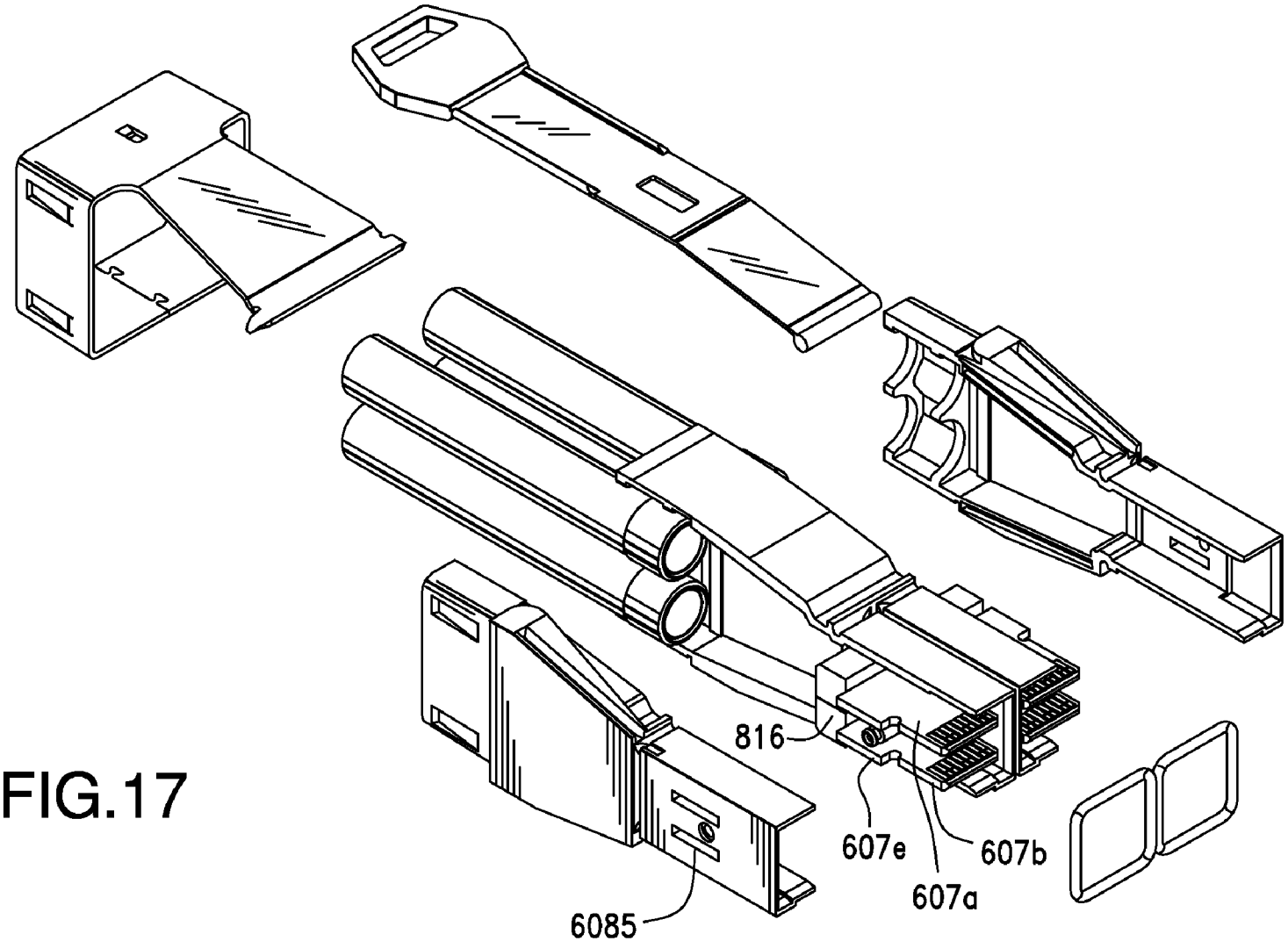
FIG. 17 is the same view as FIG. 15, but with the left and right housing members and EMI gaskets removed for clarity.
Figure 18:
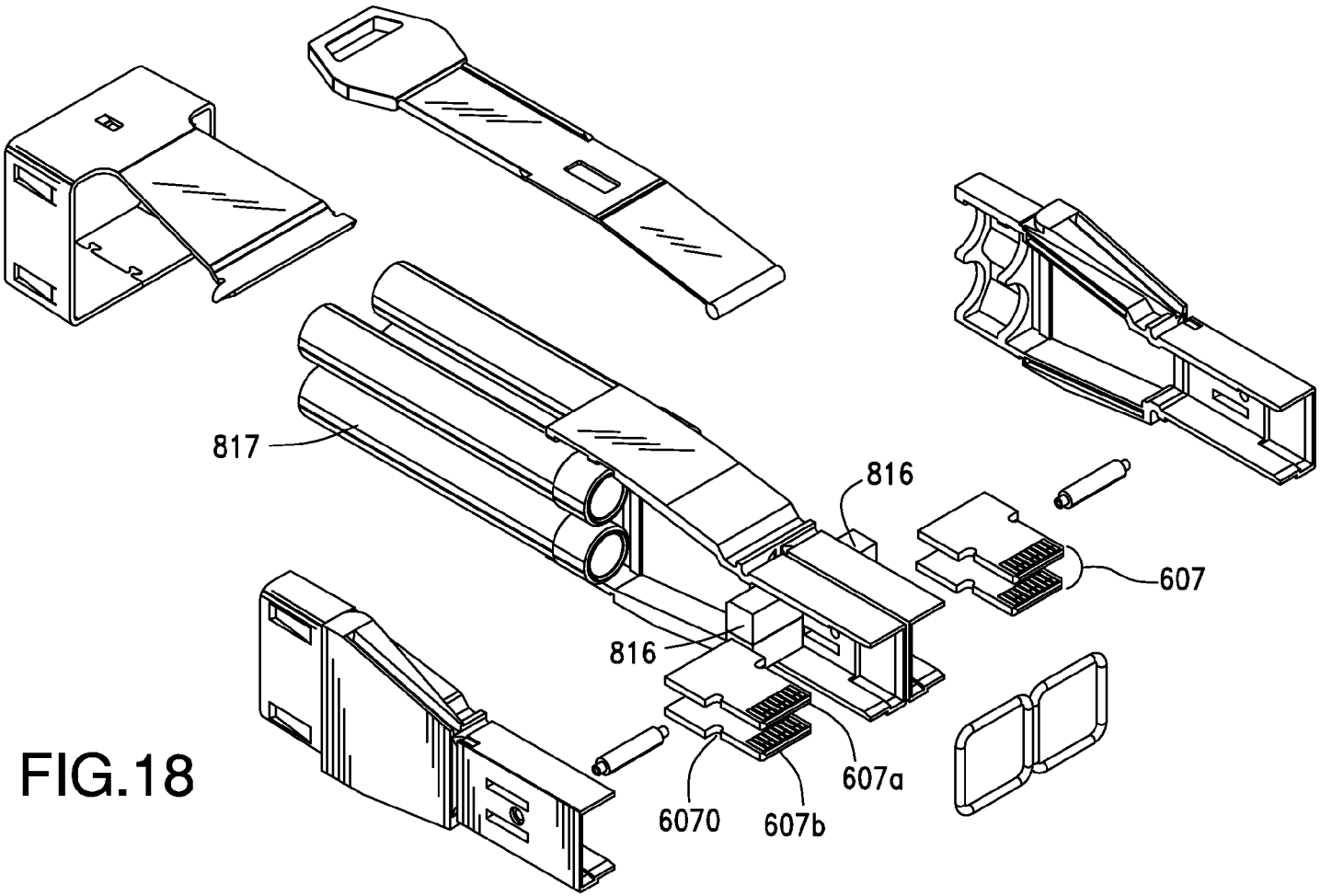
FIG. 18 is the same view as FIG. 17, but with the internal components removed for clarity.
Figure 19:
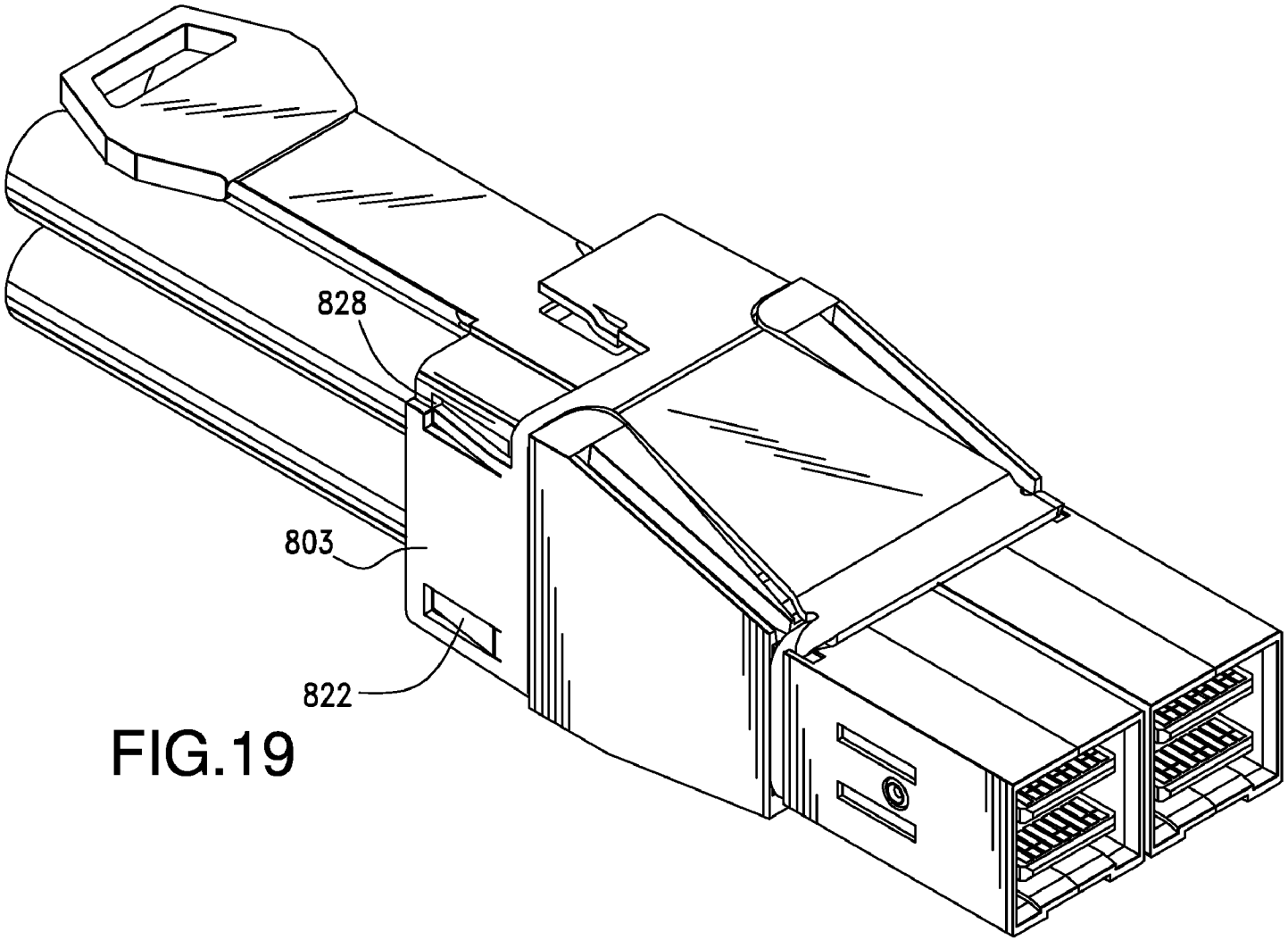
FIG. 19 is a view similar to FIG. 15 with a portion of the latching assembly retainer removed to illustrate its engagement with the actuator and connection housing body portion; and, FIG. 20 is an enlarged detail view of the latching assembly retainer and its engagement on the connector housing.

As shown in FIGS. 15-16, the latching member retaining collar 851 is punched, or stamped, to form engagement tabs 822 that are bent inwardly and which are received within corresponding slots 823 that are formed in the exterior surfaces of the connector housing 801 on the collar-mounting channel or recess 675 thereof. The free end of each engagement tab 822 is seen to abut a wall, or shoulder 828 of the housing slot 823 and the tab 822 serves to retain the collar 803 in place upon the connector housing 801. Likewise, the collar 803 may have an additional tab 824 that is disposed in its top portion and which depends through a opening 825 disposed in the actuator so as to retain it in place on the connector housing 801 in a permanent fashion. The collar 803 may also be dimensioned slightly smaller or the same as the trailing edge of the connector housing 801 so as to provide a tight interference fit on the connector housing and exert a fastening pressure on the multiple pieces that make up the housing.

It will be understood that there are numerous modifications of the illustrated embodiments described above which will be readily apparent to one skilled in the art, such as many variations and modifications of the connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A connector, comprising:

a two-piece connector housing including at least one mating portion and a body portion, the at least one mating portion being disposed forwardly of the housing body portion and being sized to fit within a receptacle of an opposing, mating connector;

a latching member supported by the body portion, the latching member including a retainer for retaining the latching member in place upon the body portion, and a latching arm that projects from the retainer in a cantilevered fashion, the latching arm extending from the body portion toward the at least one mating portion and terminating in an engagement end, the retainer engaging a majority of the body portion perimeter; and an actuator for moving the latching arm between first and second operative positions, the actuator including a first end that protrudes outwardly away from the body portion and a second end that extends toward the at least one mating portion, the actuator second end being interposed between the latching member and the connector housing, the second end further including a cam end disposed thereon, whereby movement of the actuator causes the engagement end to be raised above the at least one mating portion.

2. The connector of claim 1, wherein the actuator cam end includes an enlarged member and the connector housing includes a ramped surface disposed on the connector housing body portion and extending toward the connector housing mating portion, the enlarged member riding against the ramped surface and sliding upwardly as the actuator is pulled in a direction away from the connector housing mating portion, the upward movement of the enlarged member causing it to contact the latching member and lift the latching member engagement end away from the connector housing at least one mating portion.

3. The connector of claim 2, wherein the enlarged member has a cylindrical configuration which is oriented transversely to the ramped surface.

4. The connector of claim 1, wherein the latching arm engagement end includes at least one engagement hook configured to extend into an opening in a surface of an opposing mating structure when the connector is inserted into the opposing mating structure.

5. The connector of claim 4, wherein the latching arm has a free end that is wider than a portion of the latching arm that meets the retainer.

6. The connector of claim 1, wherein the connector housing body portion includes a channel extending around substantially a perimeter of the connector housing body portion and the latching member retainer is disposed in the channel.

7. The connector of claim 1, wherein the latching member retainer engages at least two opposing sides of the connector housing body portion.

8. The connector of claim 1, wherein the latching member retainer engages at least three distinct sides of the connector housing body portion.

9. The connector of claim 1, wherein the retainer is slightly smaller than a portion of the connector housing it engages such that the retainer elastically deforms when applied to the connector housing.

10. The connector of claim 9, wherein the portion of the connector housing engaged by the retainer has a first taper and the retainer has a second taper, the first and second tapers being different.

11. The connector of claim 1, wherein the retainer is substantially U-shaped.

12. The connector of claim 1, wherein the connector housing body portion includes a cylindrical portion and the retainer engages more than one-half a circumference of the cylindrical portion.

13. The connector of claim 1, wherein the retainer extends around an entire perimeter of the connector housing body portion.

14. The connector of claim 1, wherein the housing body portion includes a plurality of recesses and the retainer includes a plurality of engagement members which engage the plurality of recesses in the housing body portion.

15. The connector of claim 1, wherein the connector housing mating portion includes a hollow interior cavity which houses a plurality of horizontal orientated mating blades that are vertically spaced apart.

16. The connector of claim 1, wherein the connector housing mating portion includes a plurality of hollow interior cavities that are open at the mating end of the connector, each cavity including a plurality of horizontal orientated mating blades which are vertically spaced apart, and the latching arm free end extends transversely over both of the hollow interior cavities.

17. The connector of claim 14, wherein the plurality of hollow interior cavities form a first and second mating portion, the first and second mating portion separated from each other by an intervening slot.

18. The connector of claim 14, wherein the actuator includes, at the second end thereof, a pull tab having a width greater than a width of any of the hollow interior cavities.

19. The connector of claim 1, wherein the connector housing body portion has a height and a width that are larger than a corresponding height and width of the at least one mating portion.

20. A connector with a latching mechanism, comprising:

a housing, the housing having a mating end and a rear end with an aperture configured to receive at least one electrical cable therein;

a latching clip supported by the housing, the latching mechanism including a retainer that clampingly engages the housing and an engagement end disposed opposite the retainer and a body portion extending therebetween, the engagement end including an engagement member for engaging, in operation, an opposing connector, the engagement end configured to translate in a vertical direction; and an actuator having a free end that is interposed between the housing and the latching clip, the actuator being capable of horizontal movement, whereby horizontal movement of the actuator causes vertical movement in the engagement end.

21. The connector of claim 20, wherein the housing includes two horizontally aligned mating blades positioned in the mating end and the aperture is a first aperture, the housing further including a second aperture in the rear end, the first and second aperture vertically aligned and configured to hold two cables in a vertical arrangement.

22. The connector of claim 20, wherein the housing includes two recesses and the retainer includes two engagement members that engage the two recesses.

23. The connector of claim 20, wherein the retainer includes a collar that extends around an entire perimeter of the connector.

24. The connector of claim 23, wherein the free end includes a cam end, the cam end having an enlarged member extending transversely to the latching arm and wherein the body portion has a width that varies along its extent from the retainer to the free end.

25. The connector of claim 20, wherein the retainer elastically deforms when applied to the housing.

* * * * *